US006702279B2

(12) United States Patent
Adachi et al.

(10) Patent No.: US 6,702,279 B2
(45) Date of Patent: Mar. 9, 2004

(54) SHEET TREATING APPARATUS

(75) Inventors: Seiichiro Adachi, Chiba (JP); Kenichi Hayashi, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 41 days.

(21) Appl. No.: 09/865,547

(22) Filed: May 29, 2001

(65) Prior Publication Data

US 2002/0008350 A1 Jan. 24, 2002

(30) Foreign Application Priority Data

May 29, 2000 (JP) ..... 2000-157888

(51) Int. Cl.[7] ..... B65H 31/26
(52) U.S. Cl. ..... 271/220; 271/221
(58) Field of Search ..... 271/220, 221, 271/207; 270/58.12

(56) References Cited

U.S. PATENT DOCUMENTS

| | | | | |
|---|---|---|---|---|
| 5,443,248 | A | 8/1995 | Hayashi et al. | 270/53 |
| 5,499,811 | A | 3/1996 | Hayashi et al. | 271/293 |
| 5,678,818 | A | 10/1997 | Hayashi et al. | 271/292 |
| 5,735,515 | A | 4/1998 | Hayashi et al. | 270/58.11 |
| 5,774,778 | A | 6/1998 | Adachi et al. | 399/403 |
| 5,938,186 | A | 8/1999 | Sato et al. | 270/58.11 |
| 5,951,000 | A | 9/1999 | Sato et al. | 270/58.11 |
| 5,961,110 | A | 10/1999 | Adachi et al. | 270/58 |
| 6,076,825 | A | 6/2000 | Kato et al. | 271/207 |
| 6,264,194 | B1 * | 7/2001 | Hayashi et al. | 271/220 |
| 6,290,220 | B1 * | 9/2001 | Takehara et al. | 270/58.12 |
| 6,412,774 | B1 * | 7/2002 | Saito et al. | 271/220 |

FOREIGN PATENT DOCUMENTS

| | | |
|---|---|---|
| JP | 11-199123 | 7/1999 |

* cited by examiner

*Primary Examiner*—David H. Bollinger
(74) *Attorney, Agent, or Firm*—Fitzpatrick, Cella, Harper & Scinto

(57) ABSTRACT

A sheet treating apparatus includes a stacking tray, a delivery rotary member, an endless belt member, and a traction device. The stacking tray has a stacking surface for receiving and stacking sheets thereon and a stopper portion for regulating the end portions of the sheets. The delivery rotary member delivers the sheets to the stacking tray. The endless belt member contacts with and acts on the upper surface of the sheets on the stacking tray, and feeds the delivered sheet so as to pull the end portion thereof into the stopper portion. The traction device pulls a portion of the endless belt member in a predetermined direction. During sheet feeding caused by the endless belt member, the traction device is operated in conformity with the height of the sheets stacked on the stacking tray to thereby control the contact pressure of the endless belt member against the sheets stacked on the stacking tray so as to become substantially constant. The stacking tray is inclined so that the downstream side thereof in the delivery direction of the sheet may become higher. The delivered sheet is switched back to return with the direction thereof changed over, and the stopper portion is provided on the downstream side in the direction of return of the sheet. The endless belt member is supported with a portion of its inner peripheral surface twined around the delivery rotary member and is rotated with the delivery rotary member.

22 Claims, 30 Drawing Sheets

SHEET TREATING APPARATUS

BACKGROUND OF THE INVENTION

1. Field of the Invention

The invention relates to a sheet treating apparatus in a copier, a laser beam printer or the like, and an image forming apparatus provided with the same, and more particularly to a sheet treating apparatus improved so that during the alignment and stitching process of sheets on the surfaces of which images have been formed by an image forming apparatus and which are delivered, particularly the processing operation of aligning the sheets, the grouping of the sheets by aligning means can be effected and also the alignment of the grouped sheet bundle can be effectively effected, and an image forming apparatus provided with such sheet treating apparatus.

2. Related Background Art

Generally, as sheet treating apparatuses, there have already been proposed and put into practice numerous apparatuses comprising a combination of first treating means for aligning and grouping sheets on which images have been formed and stapling a part of the bundle sheet as required, and second treating means for receiving and containing each aligned sheet bundle or stapled sheet bundle, including apparatuses disclosed, for example, in Japanese Patent Application Laid-Open No. 11-199123.

The construction of the aligning portion of a conventional sheet treating apparatus of this type is schematically shown in FIG. 33 of the accompanying drawings. In FIG. 33, the conventional sheet treating apparatus is comprised of a pair of carrying-out rollers 701 comprising a lower carrying-out roller 701*a* and a carrying-out roller 701*b* for carrying out sheets P from a sort path 700, a treating unit 800 having first treating means for receiving, aligning and grouping the sheets P carried out, and stapling a part of the sheet bundle as required, and a stack tray 900 for containing and stacking therein each sheet bundle bundle-delivered after treatment.

Knurled belts 702 are wound on several axial locations between the lower carrying-out roller 701*a* and the carrying-out roller 701*b* of the pair of carrying-out rollers 701, and sheet guides 703 are disposed at appropriate locations among the knurled belts 702.

The treating unit 800 has a treating tray 801 inclined by the downstream side (the left upper portion as viewed in FIG. 33) thereof with respect to the direction of delivery of the sheets P being positioned upwardly and the upstream side (the right lower side as viewed in FIG. 33) thereof being positioned downwardly, a trailing end stopper portion 802 at the upstream side end portion, a pair of right and left aligning members 803 in the widthwise direction of the sheet, a pair of bundle delivery rollers 804 comprising a set of lower and upper bundle delivery rollers 804*a* and 804*b* disposed downstream of the treating tray 801, a swingable guide 805 having an upper bundle delivery roller 804*b* on the underside of the leading end thereof, and supporting the upper bundle delivery roller 804*b* for movement toward and away from the lower bundle delivery roller 804*a*, and a pull-in paddle 806 disposed above the intermediate portion.

In this case, the lower and upper bundle delivery rollers 804*a* and 804*b* of the pair of bundle delivery rollers 804 receive the sheet P from the pair of carrying-out rollers 701 onto the treating tray 801 with the upper bundle delivery roller 804*b* brought into its open state in which it is spaced apart from the lower bundle delivery roller 804*a* by the swinging control of the swingable guide 805, and the upper bundle delivery roller 804*b* is brought into its closed state in which it is in contact with the lower bundle delivery roller 804*a* in synchronism with the termination of the reception, and also the lower bundle delivery roller 804*a* is rotatively driven in a clockwise direction to thereby bias the received sheet P so as to pull it back to the upstream trailing end stopper portion 802 side, i.e., the upstream side, on the treating tray 801, and then the upper bundle delivery roller 804*b* is again spaced apart from the lower bundle delivery roller 804*a*.

Also, the sheet P biased to the upstream side is continuedly subjected to the pulling-back action by the rotative driving of the pull-in paddle 806 and also is aligned by the operation of the aligning members 803, and the feeding-in action for the end portion of the sheet by the rotation of the knurled belts 702 is applied thereto, and the sheet P is dashed against the trailing end stopper portion 802 via the sheet guides 703, and the aligning operation is terminated in this manner.

The knurled belts 702, as shown in FIG. 33, are wound on the lower delivery roller 701*a* adjacent to the lower portion between the pair of carrying-out rollers 701, i.e., adjacent to the treating tray 801 and are made rotatable and also, there is provided an idle runner 791 idly rotated in contact with the lower inner peripheral surface of the knurled belts 702, and during the paddling and aligning operations which will be described below, and particularly at the start of the aligning operation performed subsequently to the paddling operation, the idle runner 791 is pulled and operated toward the rearward side (the right side) as viewed in FIG. 33, and further to the supporting surface side of the trailing end stopper portion 802 by a solenoid 792 through a link 793, whereby the knurled belts are pulled toward the inner side of the sheet guide 703 above them and are deformed (as indicated by the broken line in FIG. 33) so as not to hamper the sheet P from being dashed against the trailing end stopper portion 802.

The sheet P delivered from the pair of carrying-out rollers 701 slides on the treating tray 801 until it is dashed against the dashing support surface 802*a* of the trailing end stopper portion 802 by its own gravity and the action of the pull-in paddle 806 which will be described later and the feeding action by the underside of the knurled belts 702 while the trailing end edge of the sheet P is downwardly guided by the sheet guides 703.

The sheet P having dashed is aligned widthwisely of the sheet by the aligning members 803 to thereby form a sheet bundle.

The sheet bundle aligned on the treating tray 801 is subjected to the stitching process and so on at the aligning position, whereafter the upper bundle delivery roller 804*b* is brought into contact with the lower bundle delivery roller 804*a*, and the lower bundle delivery roller 804*a* is now rotatively driven in a counter-clockwise direction, whereby the sheet bundle having been subjected to the treatment is bundle-delivered onto the stack tray 900.

In the above-described example of the conventional art, however, the knurled belts have been driven at two positions, i.e., a position in which they contact with the sheet shown in FIG. 33 and feed the end portion of the sheet to the trailing end stopper portion 802 and a retracted position in which they are completely spaced apart from the sheet and are hidden behind the sheet guides 703.

Therefore, when as shown in FIG. 32 of the accompanying drawings, the number of sheet bundles is great (the height of the bundles is great), the area of contact between the sheet P and the knurled belts 702 becomes large and therefore, the feeding-in force for the sheet P becomes greater than necessary and the sheet P might run upon the trailing end stopper portion 802 or might be buckled. On the other hand, if the height of the knurled belt 702 at the feeding-in position is made great in accordance with the case where the height of sheet bundles is great, when the number of sheet bundles stacked in the treating tray 801 is small, the area of contact between the sheet P and the knurled belt 702 will become small or they will not come into contact with each other, and the feeding-in force for the sheet will become small and it may become impossible to feed the sheet P to the trailing end stopper portion 802.

SUMMARY OF THE INVENTION

So, it is the object of the present invention to provide a sheet treating apparatus which always makes the feeding force of an endless belt member substantially constant irrespective of the number of sheets stacked on a treating tray, and can effect more stable stacking and alignment of sheets, and an image forming apparatus provided with the same.

A typical construction according to the present invention for achieving the above object comprises stacking tray means having a stacking surface for receiving and stacking sheets thereon and a stopper portion for regulating the end portions of the sheets, a delivery rotary member for delivering the sheets to the stacking tray means, an endless belt member contacting with and acting on the upper surface of the sheets on the stacking tray means, and feeding the sheet to be delivered so as to pull the end portion thereof into the stopper portion, and traction means for pulling one end of the endless belt member in a predetermined direction, and during the sheet feeding by the endless belt member, the traction means is operated in conformity with the height of the sheets stacked on the stacking tray means to thereby control the contact pressure of the endless belt member against the sheets stacked on the stacking tray means so as to become substantially constant.

The stacking tray means is inclined so that the downstream side thereof with respect to the delivery direction may become higher, and the sheet to be delivered is switched back to return with the direction thereof changed over, and the stopper portion may preferably be provided on the downstream side with respect to the direction of return of the sheet.

The endless belt member may preferably be supported with a portion of its inner peripheral surface twined around the delivery rotary member and be rotated with the delivery rotary member.

The construction may have height detecting means for detecting the height of the sheets stacked on the stacking tray means, and the traction means may be operated in conformity with the height of the sheets detected by the height detecting means.

The number of the sheets stacked on the stacking tray means may be counted to find the height of the sheets, and the traction means may be operated in conformity with the value thereof.

In the above-described construction, the endless belt member tries to feed the sheet with a substantially constant force irrespective of the stack height of the sheet bundle and therefore, the inconvenience during stacking that the sheet does not arrive at the stopper portion of the stacking tray means or is buckled or runs upon the stopper portion can be eliminated.

Accordingly, during the sheet aligning process by aligning means for effecting such treatment as a stitching process on the stacking tray means, the endless belt member can be deformed so as not to contact with the sheet by the pulling operation for the endless belt member by the traction means, whereby the smoothness of the alignment movement of the sheet in the widthwise direction thereof can be achieved, and irrespective of the stack height of the sheet bundle, the endless belt member tries to feed the sheet with a substantially constant force and therefore, the inconvenience during stacking that the sheet does not arrive the stopper portion at the rear end of the stacking tray means or is buckled or runs upon the stopper can be eliminated.

Also, the traction means is made to perform an upwardly pulling operation relative to the stacking surface of the stacking tray, whereby at a smaller movement stroke, the endless belt member can be retracted from the sheet, and the time required for control becomes short and productivity is improved, or the size of the apparatus can be made small.

Further, provision is made of height detecting means for detecting the height of the sheet bundle stacked on the stacking tray means, and the amount of traction is determined on the basis of information detected by the height detecting means, whereby it becomes possible to more accurately uniformize the amount of contact between the sheet bundle and the endless belt member and further, the feeding force of the endless belt member, and the inconvenience during stacking can be eliminated.

The present invention is constructed as previously described and therefore, the endless belt member tries to feed the sheet with a substantially constant force irrespective of the stack height of the sheet bundle and therefore, the inconvenience during stacking that the sheet does not arrive at the stopper portion at the rear end of the stacking tray means or is buckled or runs upon the stopper portion can be eliminated.

Accordingly, during the sheet aligning process by the aligning means for effecting such treatment as a stitching process on the stacking tray means, the endless belt member can be deformed so as not to contact with the sheet by the pulling operation for the endless belt member by the traction means, whereby the smoothness of the alignment movement of the sheet in the widthwise direction thereof can be achieved, and irrespective of the stack height of the sheet bundle, the endless belt member tries to feed the sheet with a substantially constant force and therefore, the inconvenience during stacking that the sheet does not arrive at the stopper portion at the rear end of the stacking tray means or is buckled or runs upon the stopper can be eliminated.

Also, the traction means is made to perform an upwardly pulling operation relative to the stacking surface of the stacking tray, whereby at a smaller movement stroke, the endless belt member can be retracted from the sheet, and the time required for control becomes short and productivity is improved or the size of the apparatus can be made small.

Further, provision is made of height detecting means for detecting the height of the sheet bundle stacked on the stacking tray means, and the amount of traction is determined on the basis of information detected by the height detecting means, whereby it becomes possible to more accurately uniformize the amount of contact between the sheet bundle and the endless belt member and further, the feeding force of the endless belt member, and the inconvenience during stacking can be eliminated.

DESCRIPTION OF THE PREFERRED EMBODIMENTS

A sheet treating apparatus according to an embodiment of the present invention and an image forming apparatus provided with the same will hereinafter be described in detail with reference to FIGS. 1 to 31.

General Construction of Image Forming Apparatus

A description will first be made of an image forming apparatus according to the present invention, wherein the image forming apparatus is provided with a sheet treating apparatus.

Figure 31:
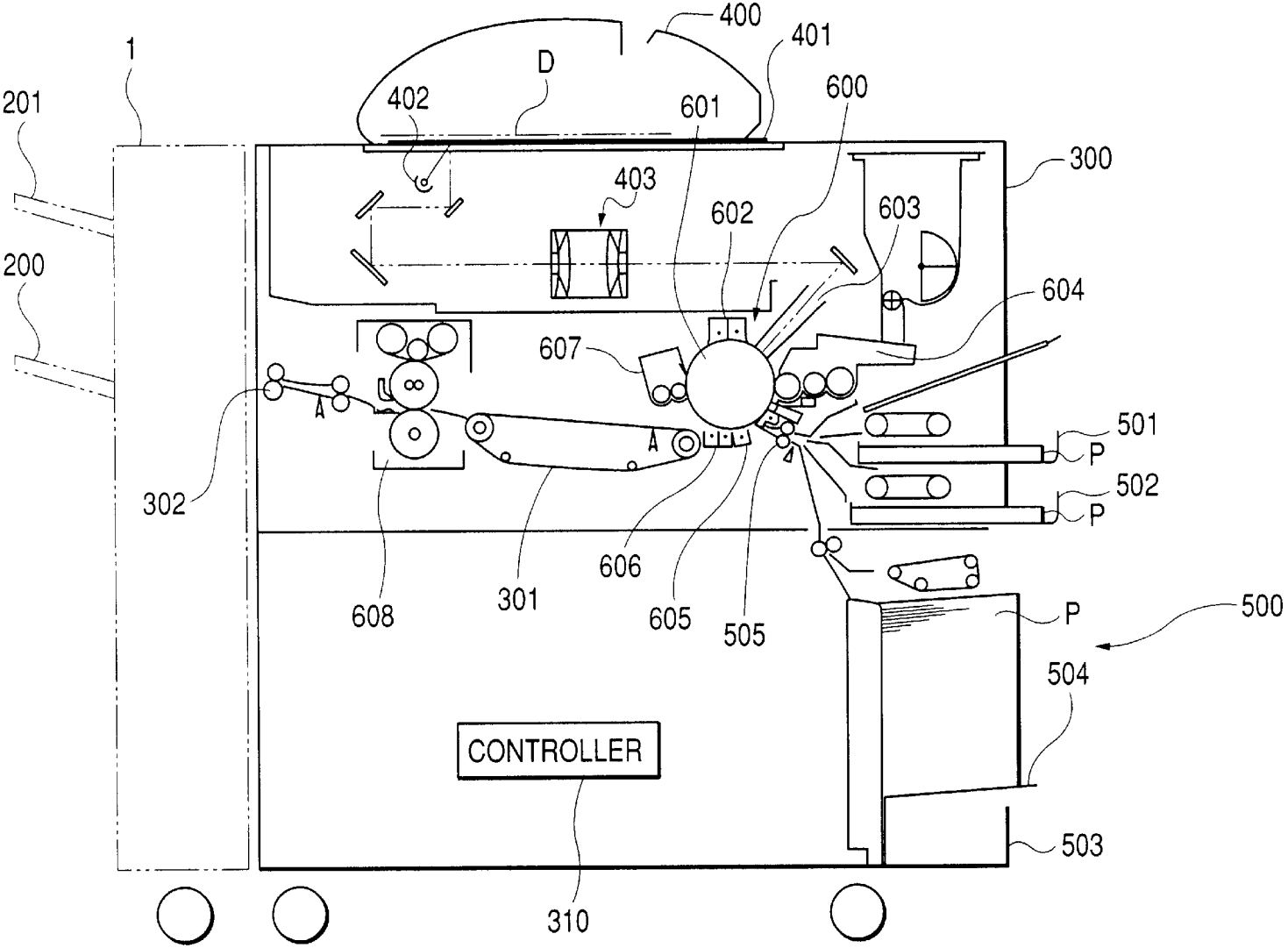
FIG. 31 is a cross-sectional illustration schematically showing the construction of an image forming apparatus provided with a sheet treating apparatus to which an embodiment of the present invention is applied.
Figure 32:
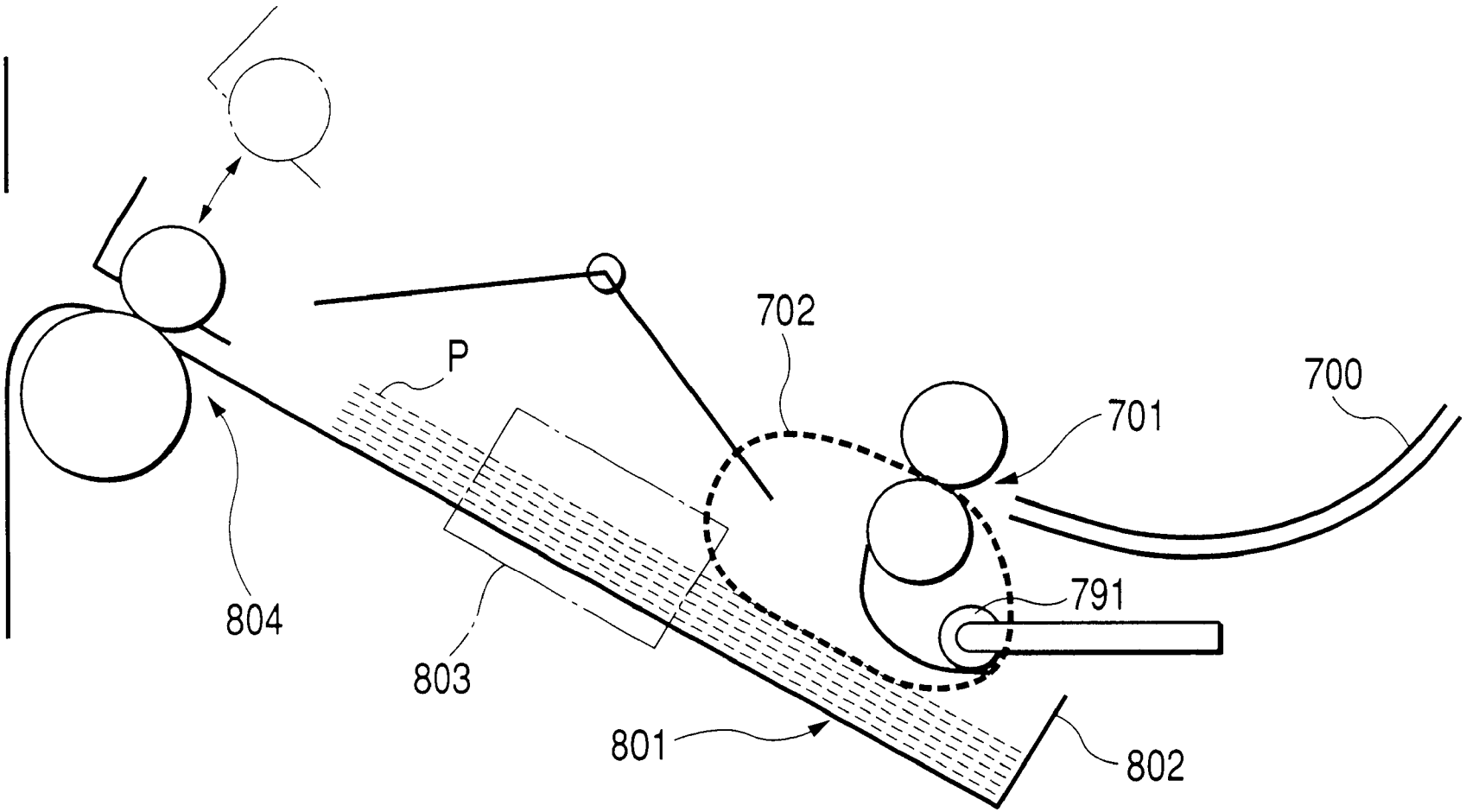
FIG. 32 is a cross-sectional illustration schematically showing the construction of a sheet aligning portion in a sheet treating apparatus according to the conventional art.
Figure 33:
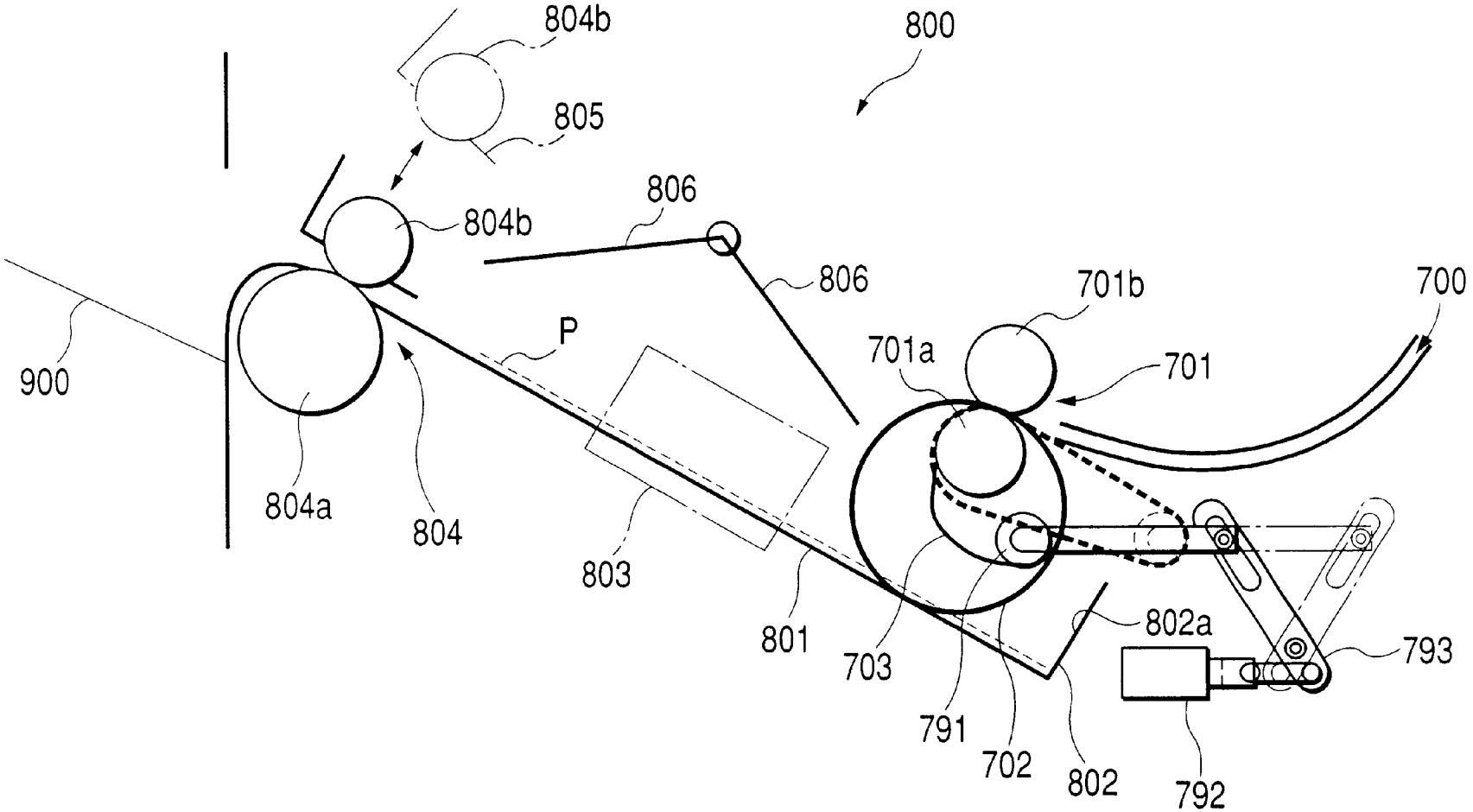
FIG. 33 is a cross-sectional illustration schematically showing the construction when a number of sheets are stacked on a sheet aligning portion in the sheet treating apparatus according to the conventional art.

FIG. 31 is a general cross-sectional illustration schematically showing the construction of an example of an image forming apparatus (copying apparatus) system provided with a sheet treating apparatus according to the present embodiment.

In the apparatus construction shown in FIG. 31, the image forming apparatus (copying apparatus) 300 is provided with an original reading portion 400 comprising an original placement stand 401 such as a platen glass plate for reading an automatically fed original D to be copied, a light source 402 and a lens system 403, a feeding portion 500 for a sheet P for forming an image thereon, an image forming portion 600, a sheet treating apparatus 1 for treating and stacking thereon the sheet P having an image formed thereon and delivered from a pair of delivery rollers 302 after image formation.

The feeding portion 500 is provided with cassettes 501 and 502 containing sheets P therein and detachably mounted on the main body of the apparatus, and a deck 504 disposed on a pedestal 503. The image forming portion 600 is provided with a cylindrical photosensitive drum 601, and a primary charger 602, an exposing portion 603, a developing device 604, a transfer charger 605, a separation charger 606, a cleaner 607 and so on around the photosensitive drum 601, and a fixing device 608 is disposed on the downstream side of the image forming portion 600 through a sheet transporting device 301.

In the above-described image forming apparatus 300, when a feed signal is outputted from a controller 310 in the main body of the apparatus, the feeding of the sheet P from the cassettes 501, 502 or the deck 504 of the feeding portion 500 is started.

On the other hand, the image of the original D placed on the original placement stand 401 is read by light from the light source 402 and is applied to the surface of the photosensitive drum 601 via the lens system 403. The photosensitive drum 601 is charged in advance by a primary charger 602 and an electrostatic latent image is formed on the surface of the drum by the application of the reading light, and the electrostatic latent image is developed by the toner of the developing device 604, whereby a corresponding toner image is formed.

The sheet P fed from the feeding portion 500 has its skew feed corrected by registration rollers 505 and is fed to the image forming portion 600 in timed relationship therewith. Then, in the image forming portion 600, the toner image on the surface of the photosensitive drum 601 is transferred onto the sheet P by the transfer charger 605, whereafter the sheet P onto which the toner image has been transferred is charged to the opposite polarity by the separation charger 606, and is separated from the surface of the photosensitive drum 601.

Thereafter, the sheet P is transported to the fixing device 608 by a sheet transporting device 301, and the transferred image is permanently fixed by this fixing device 608. The sheet P on which an image has been thus formed is delivered to the sheet treating apparatus 1 side by the pair of delivery rollers 302.

General Construction of Sheet Treating Apparatus

Figure 1:
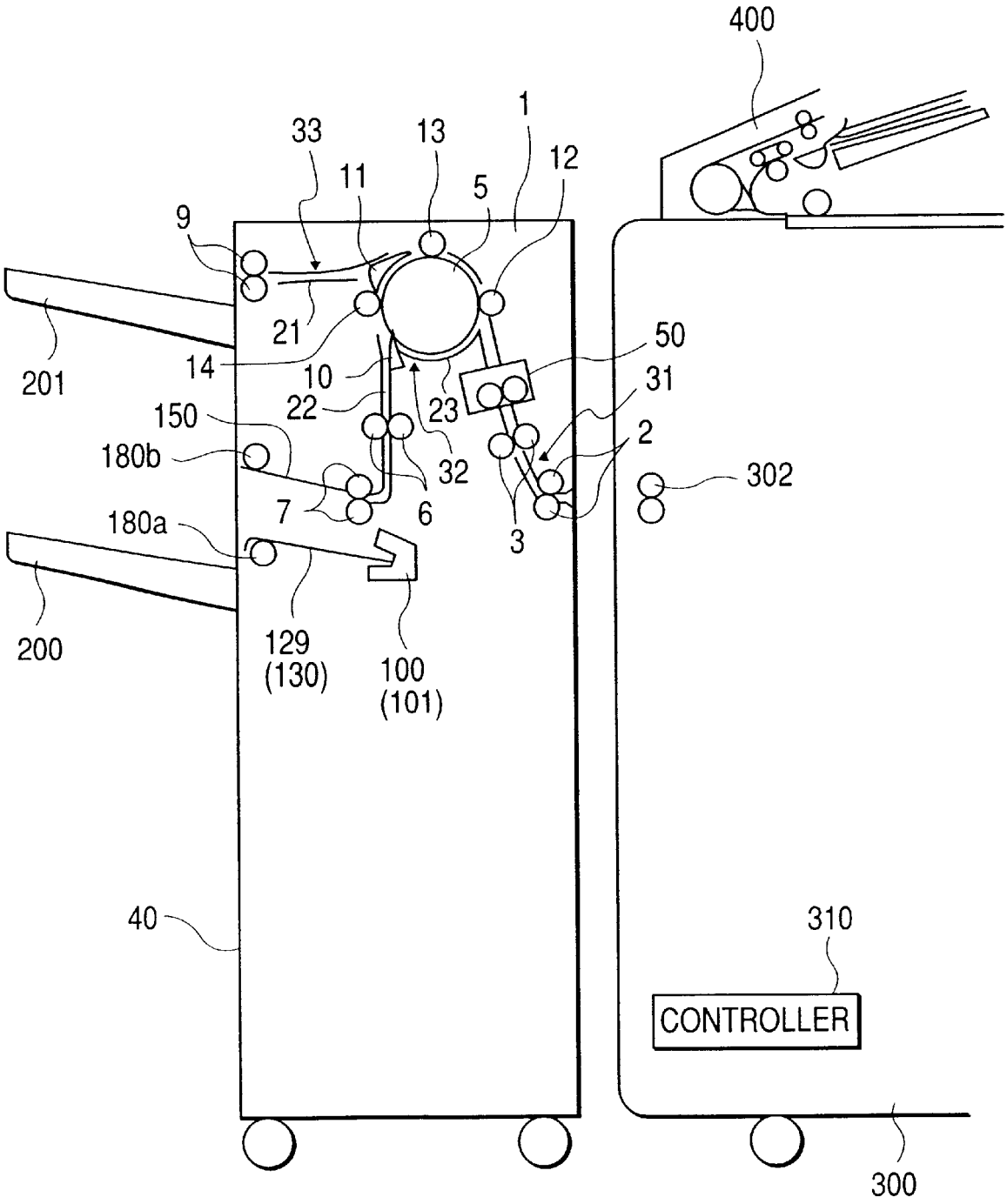
FIG. 1 is a general cross-sectional illustration schematically showing the construction of a sheet treating apparatus according to an embodiment of the present invention.

The sheet treating apparatus according to the present invention will now be described. FIG. 1 is a general cross-sectional illustration schematically showing the construction of the sheet treating apparatus according to the present embodiment.

In FIG. 1, the reference numeral 2 designates a pair of inlet rollers for receiving the sheet P delivered from the pair of delivery rollers 302 of the image forming apparatus 300, the reference numeral 3 denotes a pair of first transporting rollers for transporting the received sheet P, and the reference numeral 31 designates a sheet detecting sensor on the entrance side for detecting the passage of the sheet P. Also, the reference numeral 50 denotes a punch unit for forming perforations in the vicinity of the trailing end portion of the transported sheet. The reference numeral 5 designates a roller of a relatively large diameter (hereinafter referred to as the buffer roller) disposed on the way of transportation, and it transports the sheet P while pressing the sheet P against the surface of the roll by pressing runners 12, 13 and 14 disposed around the exterior of the roller 5.

The reference numeral 11 denotes a first changeover flapper for selectively changing over between a nonsort path 21 and a sort path 22. The reference numeral 10 designates a second changeover flapper for effecting the changeover of the sort path 22 and a buffer path 23 for temporarily storing the sheet P therein. The reference numeral 33 denotes a sensor for detecting the sheet P in the nonsort path 21, and the reference numeral 32 designates a sensor for detecting the sheet P in the buffer path 23.

The reference numeral 6 denotes a pair of second transporting rollers in the sort path 22, and the reference numeral 129 designates a treating unit including a treating tray (stacking tray means) 130 which is a first stacking tray provided to temporarily accumulate the sheets P therein and align these accumulated sheets P and also to effect staple treatment by the stapler 101 of a stapler unit 100 (stitching means). One of a pair of bundle delivery rollers which are bundle transporting means, herein a lower delivery roller 180*a* as a fixed side, is disposed on the delivery end side of the treating tray 130. The reference numeral 7 denotes a pair of first delivery rollers disposed in the sort path 22 for delivering the sheet P onto the treating tray 130, and the reference numeral 9 designates a pair of second delivery rollers disposed in the nonsort path 21 for delivering the sheet P onto a sample tray 201.

Further, the reference character 180*b* denotes an upper delivery roller supported on a swingable guide 150 and adapted to pressurizingly contact with the lower delivery roller 180*a* when the swingable guide 150 has come to its closed position, and bundle-deliver the sheets P on the treating tray 130 onto a stacking tray (second stacking tray) 200. The reference numeral 40 designates a bundle stacking guide for supporting the edge of the trailing end (the trailing end with respect to the direction of bundle delivery) of the sheet bundles stacked on the stacking tray 200 and the sample tray 201, and herein this bundle stacking guide 40 serves also as the outer packaging of the sheet treating apparatus 1.

Construction of the Staple Unit

Figure 2:
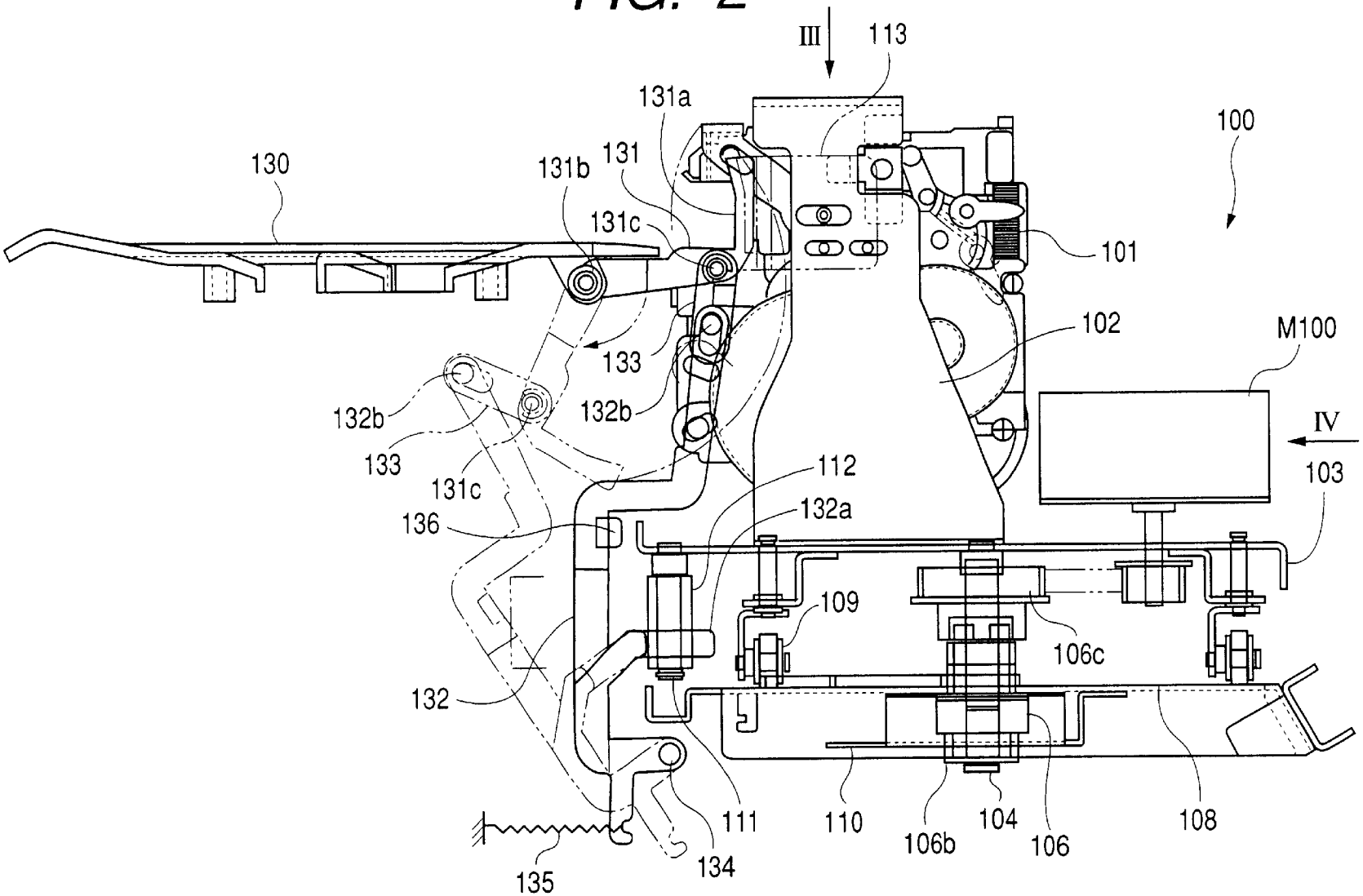
FIG. 2 is a main section side cross-sectional illustration of a staple unit.

The staple unit (stitching means) 100 will now be described with reference to FIGS. 2 to 4. FIG. 2 is a main section side cross-sectional illustration of the staple unit, FIG. 3 is a plan illustration as viewed along the direction indicated by the arrow III in FIG. 2, and FIG. 4 is a back illustration as viewed along the direction indicated by the arrow IV in FIG. 2.

The stapler (stitching means) 101 is fixed onto a movable stand 103 with a holder 102 interposed therebetween. The movable stand 103 has a set of stud shafts 104 and 105 fixed in parallel with the trailing end edge of the sheets stacked on the treating tray 130, and rolling runners 106 and 107 are rotatably assembled to the stud shafts 104 and 105, respectively, and the rolling runners 106 and 107 are movably engaged in a series of aperture-shaped guide rails 108*a*, 108*b*, 108*c* formed likewise in parallel with a fixed stand 108.

The rolling runners 106 and 107 have flanges 106*a* and 107*a* having a diameter larger than the aperture width of the series of aperture-shaped guide rails 108*a*, 108*b* and 108*c*, while on the other hand, supporting runners 109 are provided at three locations on the lower surface side of the movable stand 103 holding the stapler 101, and the movable stand 103 is moved on the fixed stand 108 along the series of aperture-shaped guide rails 108*a*, 108*b* and 108*c*.

Figure 3:
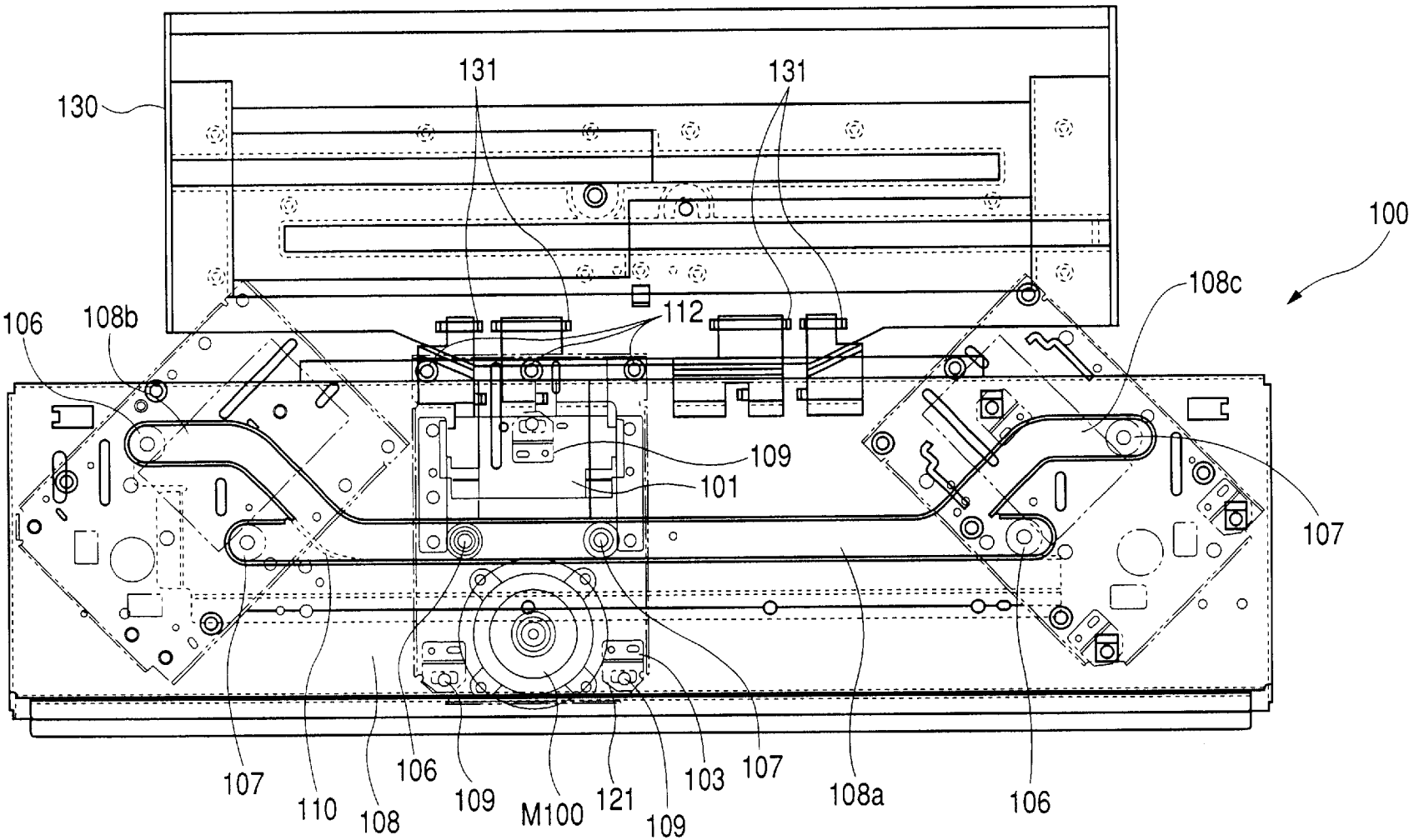
FIG. 3 is a plan illustration as viewed along the direction indicated by the arrow III in FIG. 2.
Figure 4:
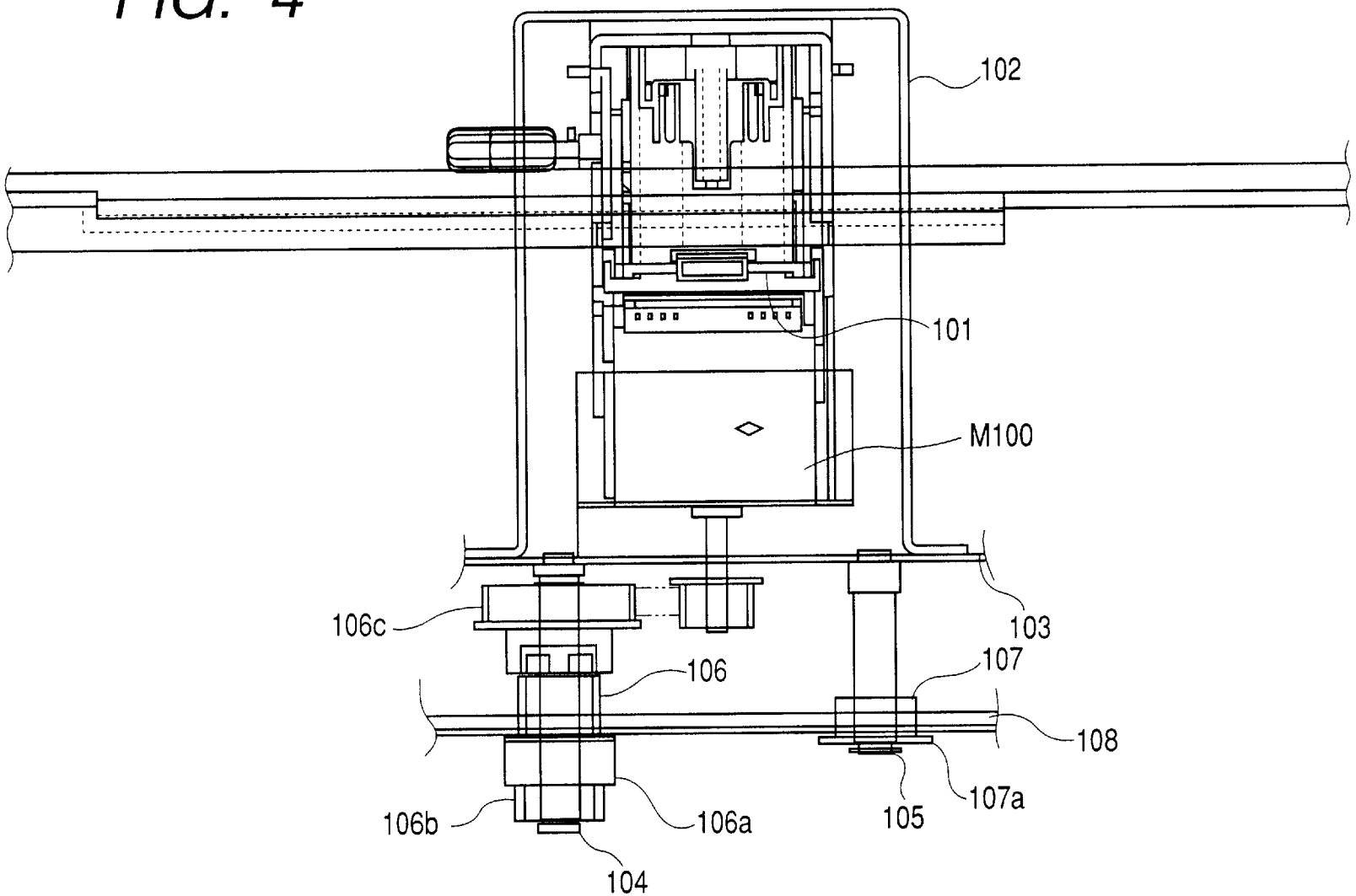
FIG. 4 is a back illustration as viewed along the direction indicated by the arrow IV in FIG. 2.

Here, the series of aperture-shaped guide rails 108*a*, 108*b* and 108*c*, as shown in FIG. 3, is formed into a shape comprising a main guide rail aperture portion 108*a*, a left end guide rail aperture portion 108*b* branching off from the left end portion side thereof and parallel therewith, and a right end guide rail aperture portion 108*c* branching off from the right end portion side thereof and parallel therewith. Accordingly, because of the rail shape of the respective portions, when the stapler 101 is positioned on the left end portion side, the rolling runner 106 is moved into the left end portion of the rail aperture portion 108*b* and the rolling runner 107 is moved into the left end portion of the rail aperture portion 108*a*, and they are maintained in a rightwardly inclined posture in which they are inclined to the right side by a predetermined angle. When the stapler 101 is positioned on the intermediate portion, the rolling runners 106 and 107 are both in the rail aperture portion 108*a* and are maintained in a parallel posture in which they are not inclined. Further, when the stapler 101 is positioned on the right end portion side, the rolling runner 107 is moved into the right end portion of the rail aperture portion 108*c* and the rolling runner 106 is moved into the right end portion of the rail aperture portion 108*a*, and the rolling runners are maintained in a leftwardly inclined posture in which they are inclined leftwardly by a predetermined angle, and the action of changing these postures is effected by an operating cam, not shown.

The staple unit 100 is provided with a position sensor, not shown, for detecting the home position of the stapler 101, and usually the stapler 101 stands by at the home position on the left end side.

A moving mechanism for the stapler 101 will now be described in detail. One rolling runner 106 of the movable stand 103 has a pinion gear 106*b* formed integrally therewith below the flange 106*a* and has a belt pulley 106*c* provided integrally therewith above it. The pinion gear 106*b* is connected through a driving belt looped around the output pulley of a driving motor M100 on the surface of the stand and the belt pulley 106*c* and is in meshing engagement with a rack gear 110 fixed to the fixed stand 108 along the rail aperture, and the movable stand 103 is movable widthwisely of the sheet with the stapler 101 correspondingly to the forward or reverse rotation of the driving motor M100.

Also, a stopper bringing-down runner 112 is provided on a stud shaft 111 downwardly extending from the underside of the movable stand 103, and this stopper bringing-down runner 112 plays the role of pivotally moving the trailing end stopper portion 131 of the treating tray 130 to avoid the collision of the trailing end stopper portion 131 with the stapler 101, as will be described later.

Trailing End Stopper Portion

A description will now be made of the trailing end stopper portion 131 for striking against and supporting the trailing end edge of the sheet P on the treating tray 130.

The trailing end stopper portion 131, as shown in FIG. 2, has a striking and supporting surface 131*a* formed vertically upwardly relative to the stacking surface of the treating tray 130 for striking against and supporting the trailing end edge of the sheet P, and this striking and supporting surface 131*a* is pivotally movable downwardly about a pivot pin 131*b* as indicated by the arrow to the underside of the treating tray 130. Also, a main link 132 provided with a cam surface 132*a* against which the stopper bringing-down runner 112 abuts and which is urged and actuated thereby is rammed against and positioned on a ramming plate 136 and is pivotally movable about a shaft 134 fixed to a frame or the like, not shown, against the force of a tension spring 135 and is connected to a pin 132*b* at the upper end portion for sliding movement in a slot in the other end portion of a connecting link 133 having one end portion thereof pivotally supported on the trailing end stopper portion 131 by a pin 131*c*.

Accordingly, in this case, with regard to the trailing end stopper portion 131 which is brought into interfering relationship with the stapler 101 with the movement of the movable stand 103, the stopper bringing-down runner 112 of the movable stand 103 urges the cam surface 132*a* of the main link 132, whereby the trailing end stopper portion 131 is pivotally moved to a non-interfering position indicated by dots-and-dash line in FIG. 2, whereby the contact thereof with the stapler 101 is avoided. After the termination of staple treatment which will be described later, the movable stand 103 is returned to its home position, whereby the trailing end stopper portion 131 is also returned to its original state. Regarding the stopper bringing-down runner 112, in order to hold the trailing end stopper portion 131 in its retracted position during the operation of the stapler 101, a plurality of (herein three) such runners are disposed in the direction of movement of the movable stand 103.

Also, a stapler stopper (indicated by the dots-and-dash line in FIG. 2) 113 having a supporting surface similar in shape to the striking and supporting surface 131*a* of the trailing end stopper portion 131 is attached to each side of a holder 102 holding the stapler 101, and the supporting of the trailing end edge of the sheet is possible even if the trailing end stopper portion 131 is in its retracted position.

Epitome of the Treating Unit

Figure 5:
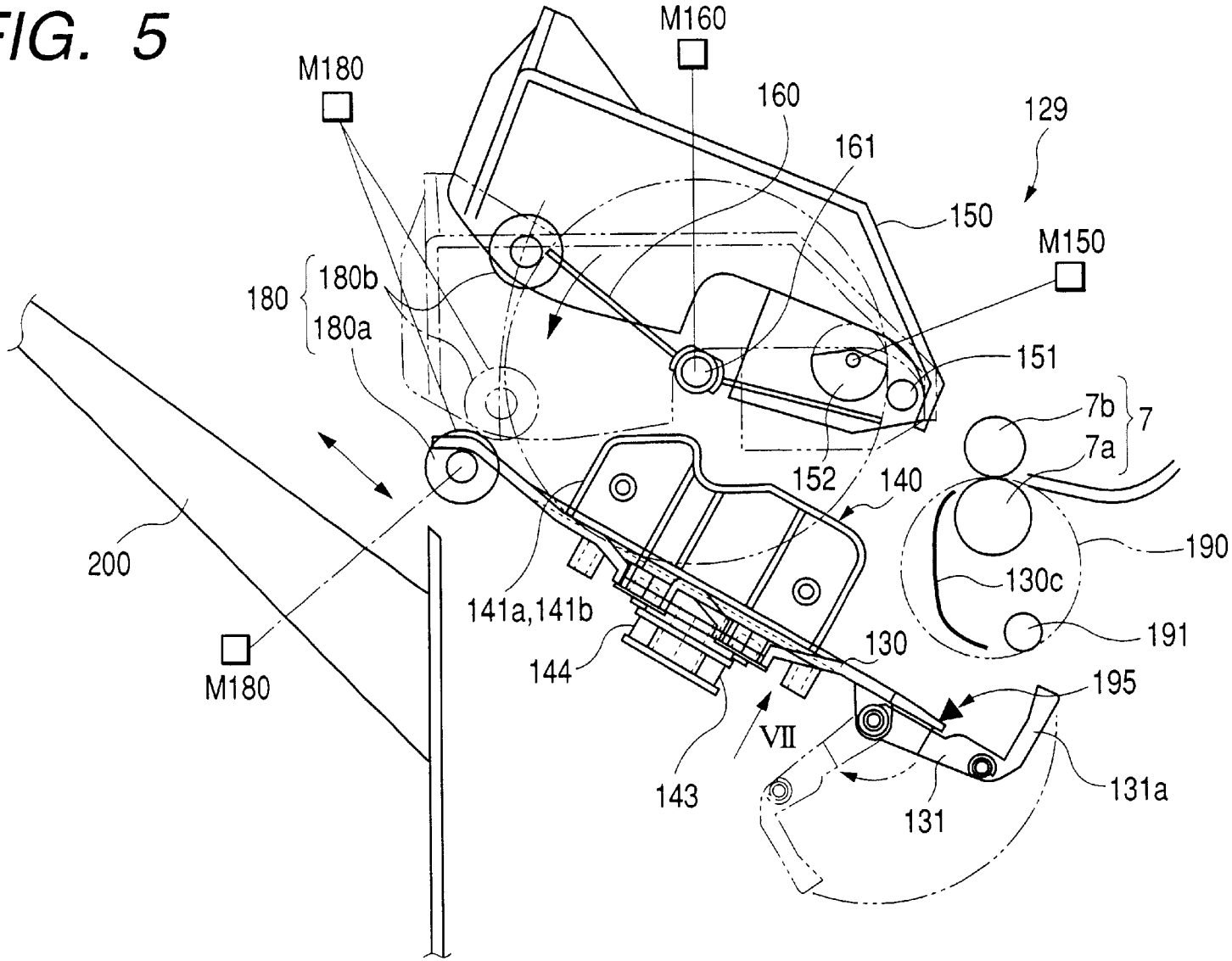
FIG. 5 is a vertical cross-sectional side illustration of a swingable guide and a treating tray.

The treating unit 129 including the treating tray 130 will now be described with reference to FIGS. 5, 6A and 6B. FIG. 5 is a longitudinal cross-sectional side illustration of a swingable guide and the treating tray, and FIGS. 6A and 6B are side illustrations showing a knurled belt and a belt moving mechanism.

The treating unit 129 constitutes the sheet treating apparatus, and is comprised of the treating tray 130, the trailing end stopper portion 131, aligning means 140, a swingable guide 150, a pull-in paddle (paddle means) 160, a pair of bundle delivery rollers 180 and a knurled belt 190 as an endless belt member rotatively driven by the afore-described pair of first delivery rollers 7.

The treating tray 130 is set in an inclined state by having its downstream side with respect to the direction of delivery of the sheet bundle (the left upper side as viewed in FIGS. 5, 6A and 6B) positioned upwardly and having its upstream side (the right lower side as viewed in FIGS. 5, 6A and 6B) positioned downwardly, and on the lower end portion thereof which is the upstream side, there are disposed sheet guides 130*c* disposed at predetermined intervals in the widthwise direction of the sheet, the knurled belt 190 and the trailing end stopper portion 131, and stack height detecting means 195 is provided near the trailing end stopper portion 131. Further, on the intermediate portion of the treating tray, the aligning means 140 is disposed occupying the external position corresponding to the left and right sides of the sheet P. Also, the swingable guide 150 including the pull-in paddle 160 and the pair of bundle delivery rollers 180 which will be described later is disposed in the upper portion which is also the downstream side, more particularly the upper area portion substantially constituting the treating unit.

Figure 6A:
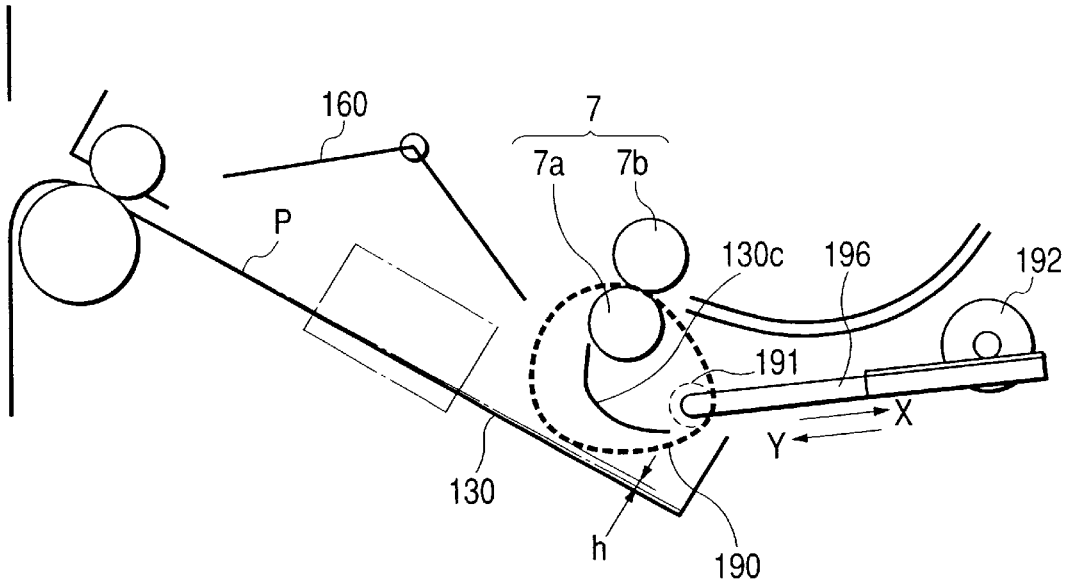
FIGS. 6A and 6B are side illustrations showing a knurled belt and a belt moving mechanism.
Figure 6B:
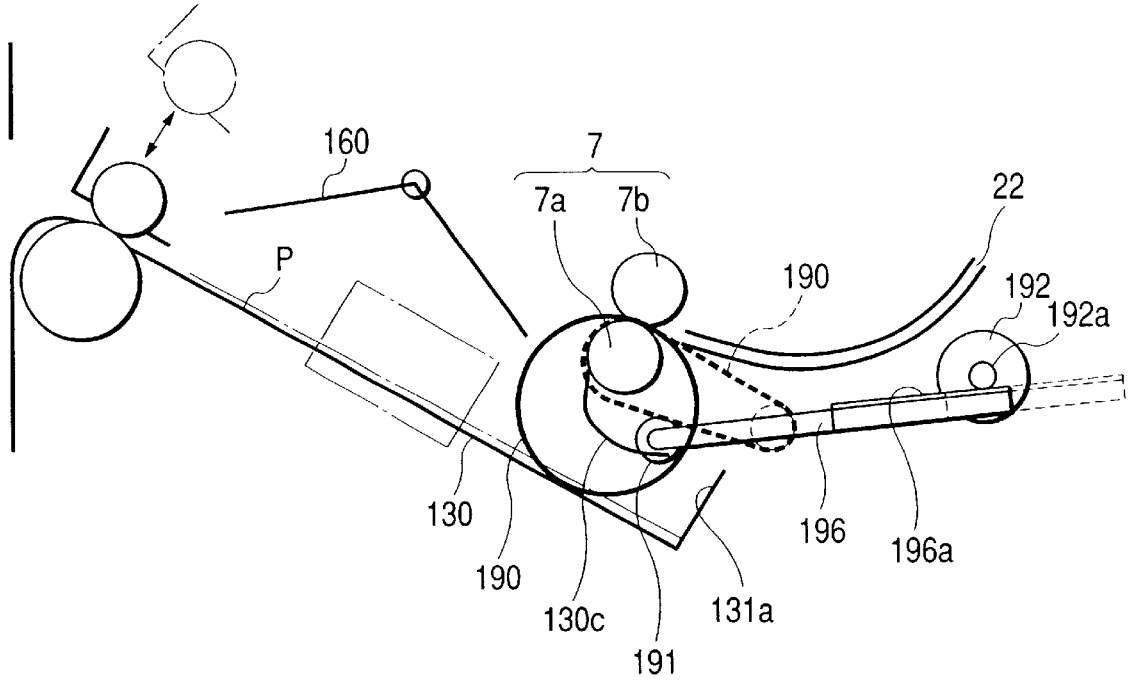

The knurled belt 190 is an endless belt formed with a nonskid knurl on the entire outer peripheral surface thereof and molded to a required diameter, and having flexibility with which it is deformable in the direction of rotation thereof, and as shown in FIGS. 6A and 6B, and is rotatably twined on the delivery roller 7*a* adjacent to the lower portion between the pair of first delivery rollers 7, i.e., adjacent to the treating tray 130 and also, a floating runner 191 floatingly rotated in contact with the lower inner peripheral surface of the knurled belt 190 is rotatably provided on a traction arm 196.

The floating runner 191 is movable in a predetermined direction by moving means comprised of the traction arm 196 or the like. Traction means for the endless belt member is constituted by the floating runner and the moving means as described above. The traction arm 196 extends at a predetermined angle with respect to the treating tray 130 toward the trailing end stopper portion 131 of the treating tray below the pair of first delivery rollers 7, and has a rack portion 196*a* formed integrally therewith. The rack portion 196*a* and a gear portion 192*a* provided on the driving shaft of a motor 192 for traction are in meshing engagement with each other. The motor 192 for traction is a pulse motor, and is designed such that the amount of rotation of the motor is determined by a pulse signal given to the motor and the floating runner 191 is pulled by an amount conforming to the amount of rotation of the motor, whereby the distance h between the knurled belt 190 and the treating tray 130 shown in FIG. 6A is changed. That is, when the floating runner 191 is traction-operated in the direction indicated by the arrow X in FIG. 6A by the motor 192 for traction, the knurled belt 190 separates from the treating tray and the sheet bundle and is deformed and retracted (indicated by the broken line in FIG. 6B) in a direction in which it is pulled toward the inside of the sheet guide 130*c* above it, and when it is retracted to maximum, it comes into the sheet guide 130*c*. Conversely, when the floating runner 191 is moved in the direction indicated by the arrow Y in FIG. 6A, the knurled belt 190 and the treating tray 130 come close to each other, and when the floating runner 191 is moved to the fore end portion, the knurled belt 190 and the treating tray 130 assume a position in which they contact with each other.

When the sheet P is delivered onto the treating tray 130, the knurled belt 190 is in a position in which it does not contact with the treating tray 130. Immediately after the sheet P has been delivered onto the treating tray 130, the knurled belt 190 is moved to its contacting position and feeds the sheet P toward the trailing end stopper portion 131. At the start of the aligning operation performed subsequently to the paddle operation which will be described next, the floating runner 191 is traction-operated in the direction indicated by the arrow X in FIG. 6A by the motor 192 for traction, whereupon the knurled belt is spaced apart from the sheet P so as not to hamper the ramming of the sheet P against the supporting surface 131*a* during the aligning operation.

When the aligning operation is terminated and the next sheet is delivered onto the treating tray 130, the floating runner 191 is again moved in the direction indicated by the arrow Y in FIG. 6A and thus, the knurled belt 190 comes into contact with the sheet P. At this time, the height of the sheet bundle stacked on the treating tray 130 is roughly detected by the stack height detecting means 195 so that the amount of movement of the floating runner 191 may be controlled in conformity with the height of the sheet bundle.

Thereby, irrespective of the height of the sheet bundle stacked on the treating tray 130, the amount of contact between the sheet P and the knurled belt 190 becomes constant. That is, as the stack height of a number of sheets stacked becomes greater, the position of the floating runner 191 when the knurled belt 190 contacts with the sheet deviates in the direction indicated by the arrow X in FIG. 6A.

Thus, the sheet P delivered from the pair of first delivery rollers 7 slides on the treating tray 130 until the trailing end edge of the sheet P is rammed against the striking and supporting surface 131*a* of the trailing end stopper portion 131 while being downwardly guided by the sheet guides 130*c* due to the gravity of its own and the action of the pull-in paddle 160 and the feeding action of the portion of contact of the belt with the sheet by the rotation of the knurled belt 190.

The amount of contact between the knurled belt 190 and the surface of the sheet becomes constant irrespective of the amount of stacked sheets and therefore, the sheet feeding force of the knurled belt 190 becomes substantially constant.

Further, as previously described, one lower delivery roller 180*a* constituting the pair of bundle delivery rollers 180 is disposed on the upper end portion of the treating tray 130, and the other upper delivery roller 180*b* separably brought into contact with the lower delivery roller 180*a* is disposed on the front end portion of the underside of the swingable guide 150, and these delivery rollers 180*a* and 180*b* are rotatable in forward and reverse directions by a driving motor M180.

While in the present embodiment, the height of the sheets stacked on the treating tray 130 is directly detected by the stack height detecting means to thereby determine the position of the floating runner 191 conforming thereto, i.e., the height position of the knurled belt 190, the number of sheets delivered onto the treating tray 130 may be counted, and from the count value and the information of the stack height by the number of sheets obtained in advance by an experiment or the like, the stack height may be conjectured, and the floating runner 191 is moved so as to determine the height position of the knurled belt 190 so that the amount of contact between the sheet and the knurled belt 190 may become constant.

Also, design may be made such that the height position of the knurled belt 190 need not be changed for each sheet, but is changed for each plural sheets (e.g. each five sheets or each ten sheets).

Aligning Means

Figure 7:
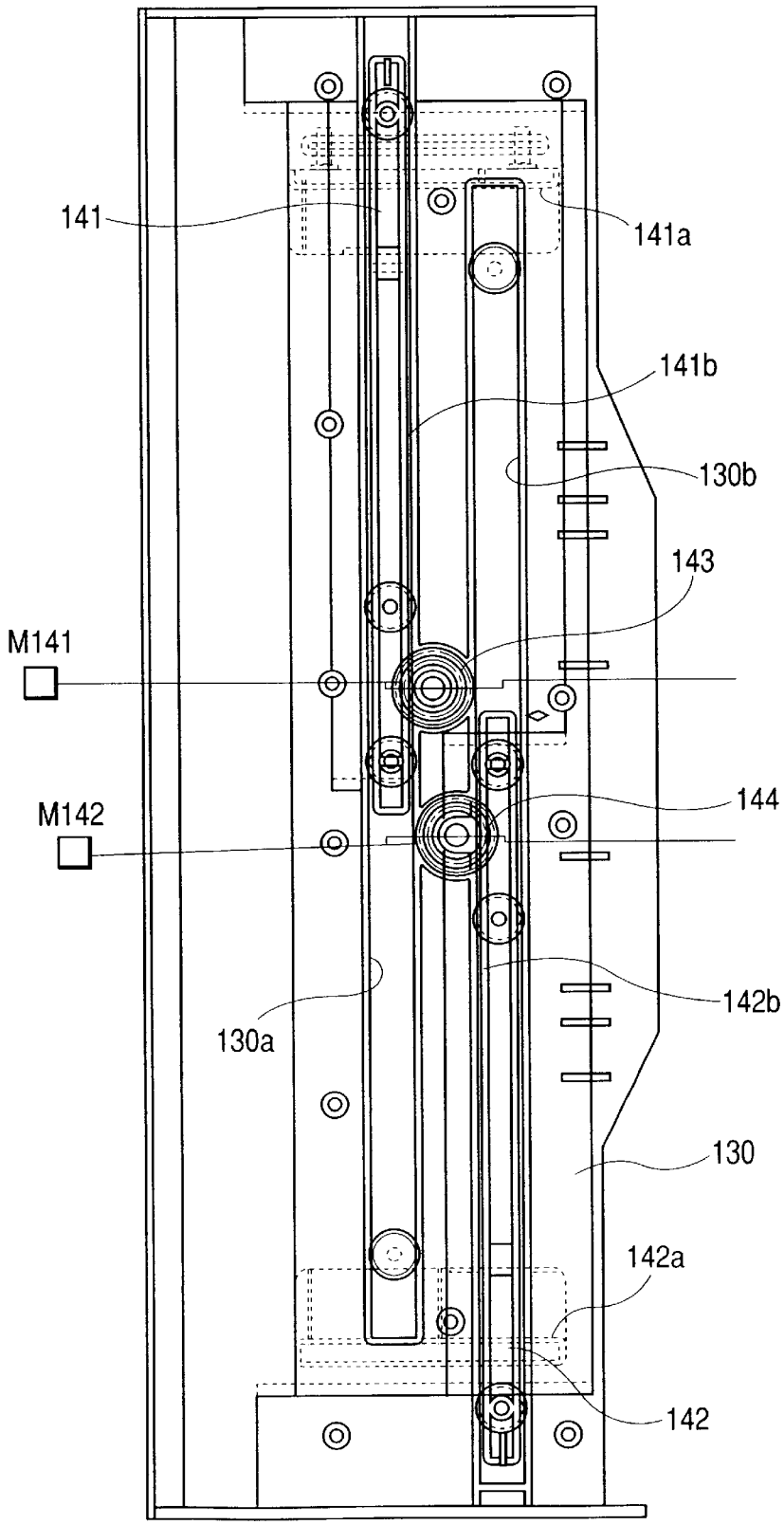
FIG. 7 is a plan illustration as viewed along the direction indicated by the arrow VII in FIG. 5 and showing the treating tray and an aligning member moving mechanism.
Figure 8:
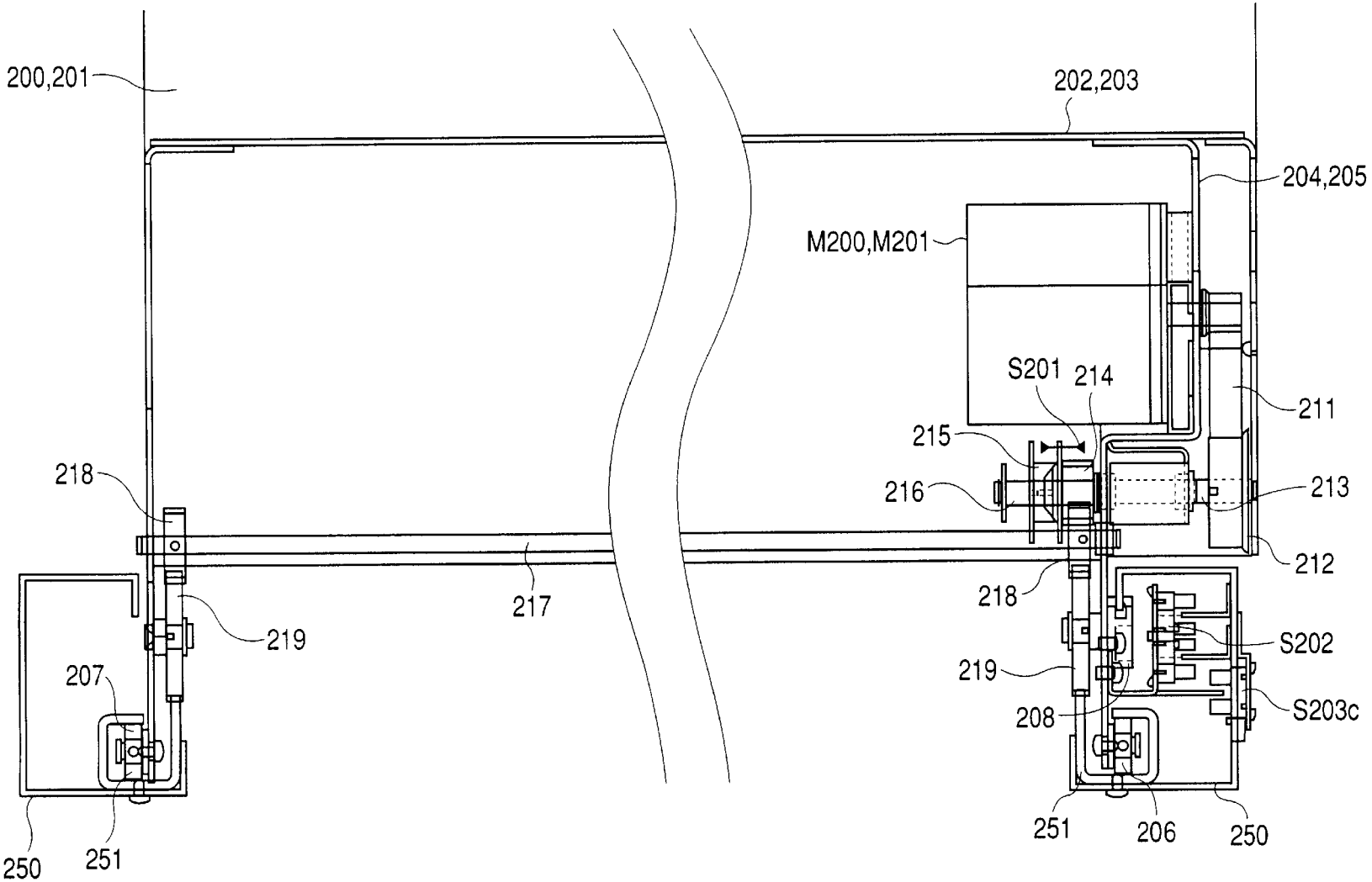
FIG. 8 is a plan illustration of a stacking tray moving mechanism.

The aligning means 140 for aligning the sheet pulled into the trailing end stopper portion 131 in a direction orthogonal to the pull-in direction will now be described with reference to FIGS. 5 to 8. FIG. 7 is a view as viewed along the direction indicated by the arrow VII in FIG. 5, and is a plan illustration of the treating tray and an aligning member moving mechanism, and FIG. 8 is a plan illustration of a stacking tray moving mechanism.

A set of aligning members 141 and 142 constituting the aligning means 140 are disposed on the surface of the treating tray 130 in opposed relationship with each other independently as a lower portion and an upper portion (corresponding to the opposite side edges of the sheet P) in FIG. 7, and one upper first aligning member 141 and the other lower second aligning member 142 have aligning surfaces 141*a* and 142*a* perpendicular to the surface of the treating tray 130 for urging and supporting the side edge of the sheet, and rack gear portions 141*b* and 142*b* for supporting the back of the sheet, and the rack gear portions 141*b* and 142*b* are disposed on the underside of the treating tray 130 through a set of guide grooves 130*a* and 130*b* parallel with the vertical direction (corresponding to the widthwise direction of the sheet P) and opened in the surface of the treating tray 130.

That is, the aligning surfaces 141*a* and 142*a* are disposed in opposed relationship with each other on the upper surface side of the treating tray 130, and the rack gear portions 141*b* and 142*b* are assembled to the underside thereof for movement in the alignment direction.

Individual pinion gears 143 and 144 driven for rotation in forward and reverse directions by respective driving motors M141 and M142 are in meshing engagement with the rack gear portions 141*b* and 142*b*, respectively, whereby the first and second aligning members 141 and 142 are made movable in the alignment direction. For the first and second aligning members 141 and 142, position sensors, not shown, for detecting their respective home positions are disposed, and in an ordinary case, the first aligning member 141 stands by at a home position set on the upper end portion thereof and the second aligning member 142 stands by at a home position set on the lower end portion thereof.

Swingable Guide

The swingable guide 150 will now be described. The swingable guide 150, as previously described, pivotally supports the upper delivery roller 180*b* contacting with the lower delivery roller 180*a* of the pair of bundle delivery rollers 180 in the front end portion of the underside corresponding to the downstream side (the left side as viewed in FIG. 5), and is pivotally supported and swingably supported by a support shaft 151 on the rear end portion of the underside corresponding to the upstream side (the right side as viewed in FIG. 5), and is swingable by the controlled driving of a rotary cam 152 by a driving motor M150, and a closed state in which the upper delivery roller 180*b* is in contact with the lower delivery roller 180*a* is the home position thereof, and a position sensor, not shown, for detecting the home position is provided.

When in an ordinary case, each individual sheet P is delivered onto the treating tray 130, the swingable guide 150 is moved to its opened state (the upper delivery roller 180*b* is spaced apart from the lower delivery roller 180*a* and the swingable guide 150 is upwardly swung) so as to enable the operations of delivery and alignment of the sheet P and the pull-in paddle operation which will be described next to be performed without hindrance, and when the sheet bundle treated on the treating tray 130 is delivered onto the stacking tray 200, the swingable guide 150 is moved to its closed state (the upper delivery roller 180*b* is brought into contact with the lower delivery roller 180*a* and the swingable guide 150 is downwardly swung).

Pull-In Paddle

The pull-in paddle 160 will now be described. The pull-in paddle 160, as shown in FIG. 5, is fixed to a driving shaft 161 above the treating tray 130, and is adapted to be rotatively driven in a counter-clockwise direction as viewed in FIG. 5 at appropriate timing by a driving motor M160, and the length of each paddle is set to a length somewhat greater than the distance to the surface of the treating tray 130, and the home position thereof is set to a position (a position indicated by the solid line in FIG. 5) which does not hinder the delivery of the sheet P from the pair of first delivery rollers 7 onto the treating tray 130.

When in this state, the delivery of the sheet P onto the treating tray 130 is done, the pull-in paddle 160 is rotatively driven in a counter-clockwise direction, whereby the sheet P delivered onto the treating tray 130, and further the trailing end edge of the sheet P is pulled in until it is rammed against the striking and supporting surface 131*a* of the trailing end stopper portion 131, whereafter in a predetermined time, it is stopped at its home position detected by a position sensor, not shown, at good timing.

Stacking Tray and Sample Tray

Figure 9:
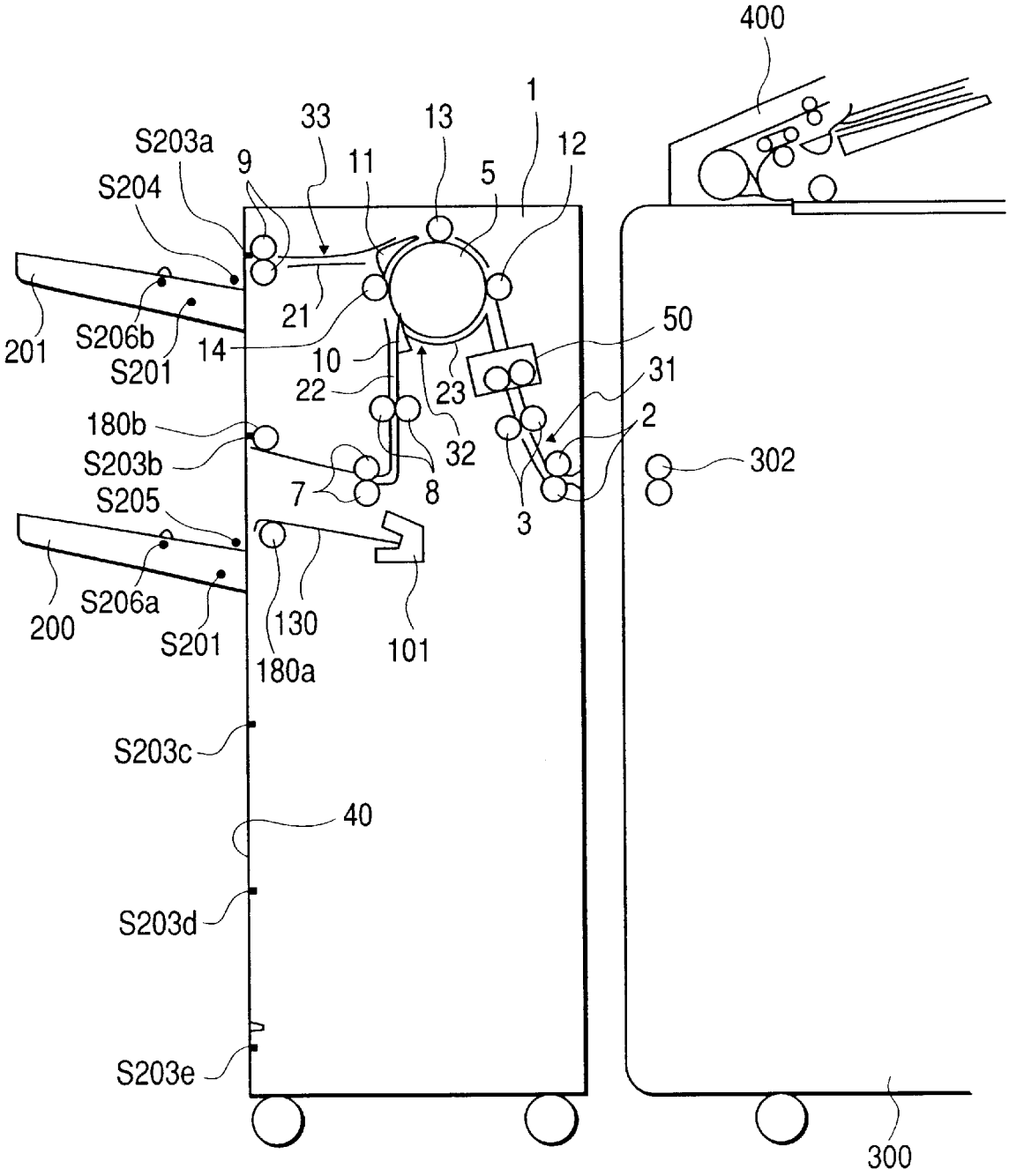
FIG. 9 is an illustration of a sensor arrangement around the stacking tray.

The stacking tray 200 and a sample tray 201 will now be described with reference to FIGS. 8 and 9. FIG. 9 is an illustration of a sensor arrangement around the stacking tray.

The stacking tray 200 and the sample tray 201 are used properly in conformity with the situation, and the stacking tray 200 disposed below is selected when it receives the sheet bundle at a copy output, a printer output and so on, and the sample tray 201 is selected when it receives sheets at a sample output, an interruption output, an output during the overflow of the stacking tray, a function output, an output during job mixed stacking or the like.

The stacking tray 200 and the sample tray 201 are held on tray base plates 202 and 203, respectively, and can independently run in a vertical direction by the use of stepping motors M200 and M201 fixed to the respective base plates 202 and 203 with mounting frame plates 204 and 205 interposed therebetween. In this case, both of the trays 200 and 201 are constructed substantially in the same mode and therefore, herein, chiefly the stacking tray 200 side only will be described.

That is, a pair of frames 250 are vertically provided on the opposite end portions of the sheet treating apparatus 1, and rack gear members 251 serving also as vertical guide rail portions are attached to the frames 250, and use is made of a pair of guide runners 206 and 207 rotatably provided on a rear end portion extended from one end (corresponding to the left end with the widthwise direction of the sheet as the reference) of the tray base plate 202 and a rear end portion extended from the mounting frame plate 204 opposed thereto (likewise corresponding to the right end) to fit the guide runners 206 and 207 into the respective guide rail portions to thereby hold the stacking tray 200 for vertical movement, and a regulating member 208 is engaged with the turned-back end edge of one frame 250 to thereby restrain and regulate the backlash in the widthwise direction of the sheet.

On the other hand, the rotational output of the stepping motor M200 is transmitted to a pulley 212 on a driving shaft 213 through a timing belt 211. A ratchet wheel 215 biased by a spring 216 and only axially slidable is provided on the driving shaft 213, and this ratchet wheel 215 is one-way-engaged with a driving gear 214 on the shaft. One of idler gears 218 disposed on the opposite end portions of a driven shaft 217 is in meshing engagement with the driving gear 214, and the idler gears 218 are in meshing engagement with the rack gear members 251 through lift gear 219. That is, the stacking tray 200 is made vertically movable through a driving system comprising these gear trains.

Also, the ratchet wheel 215 one-way-engaged with the driving gear 214 on the driving shaft 213 is provided so that during the downward movement of the stacking tray 200, the driving system may not be damaged, for example, with foreign materials interposed, and herein, a required degree of biasing force is given to the spring 216 so that only during the upward movement of the stacking tray 200, the ratchet wheel may idly rotate against the biasing force of the spring 216 correspondingly to preset conditions to thereby protect the driving system, and when such idle rotation, i.e., an abnormality, occurs, a clock slit or the like formed in the flange portion of the idler gear 218 may be immediately detected by a sensor S201 to stop the driving of the stepping motor M200. The sensor S201 is also used for the detection of a step out during the ordinary operation.

The disposition of sensors for the control of the upward and downward movement positions of the stacking tray 200 and the sample tray 201 will now be described. A sensor S202 is a sensor for detecting the stacking area of the sample tray 201, and detects that the sample tray 201 is positioned within a range from a sensor S203*a* for detecting the upward movement limit position of the sample tray 201 to a sensor S205 for detecting the surface of the sheets on the treating tray.

A sensor S203*b* is a sensor for detecting that the sheets P delivered from the pair of second delivery rollers 9 onto the sample tray 201 have reached a predetermined number, and herein it is disposed at a position corresponding to the number of stacked sheets 1,000 from a nonsort sheet surface detecting sensor S204.

A sensor S203*c* is a sensor for detecting that the sheets P delivered from the treating tray 130 onto the stacking tray 200 have reached a predetermined number, and is likewise disposed at a position corresponding to the number of stacked sheets 1,000 from the sheet surface detecting sensor S205.

A sensor S203*d* is a sensor for limiting the height of stack when the stacking tray 200 receives the sheets P from the treating tray 130, and is disposed at a position corresponding to the number of stacked sheets 2,000 from the sheet surface detecting sensor S205.

A sensor S203*e* is a sensor for setting the downward movement limit position of the stacking tray 200.

Also, sheet presence detecting sensors S206*a* and S206*b* are disposed on the stacking tray 200 and the sample tray 201, respectively.

Among these sensors, only the sheet surface detecting sensors S204 and S205 are set to a light transmitting type for detecting the presence or absence of the sheet P by the transmission of light from one side edge to the other side edge of the sheet P, and herein, as the sheet surface detecting technique thereof, a state in which the trays 200 and 201 have been moved upwardly from below the respective sheet surface detecting sensors S204 and S205 to positions covering them is initial, and after the sheets have been stacked, the trays are moved downwardly until the sensor optical axis appears, whereafter the trays are moved upwardly until they cover the sensor optical axis, and this is repeated.

Punch Unit

Figure 10:
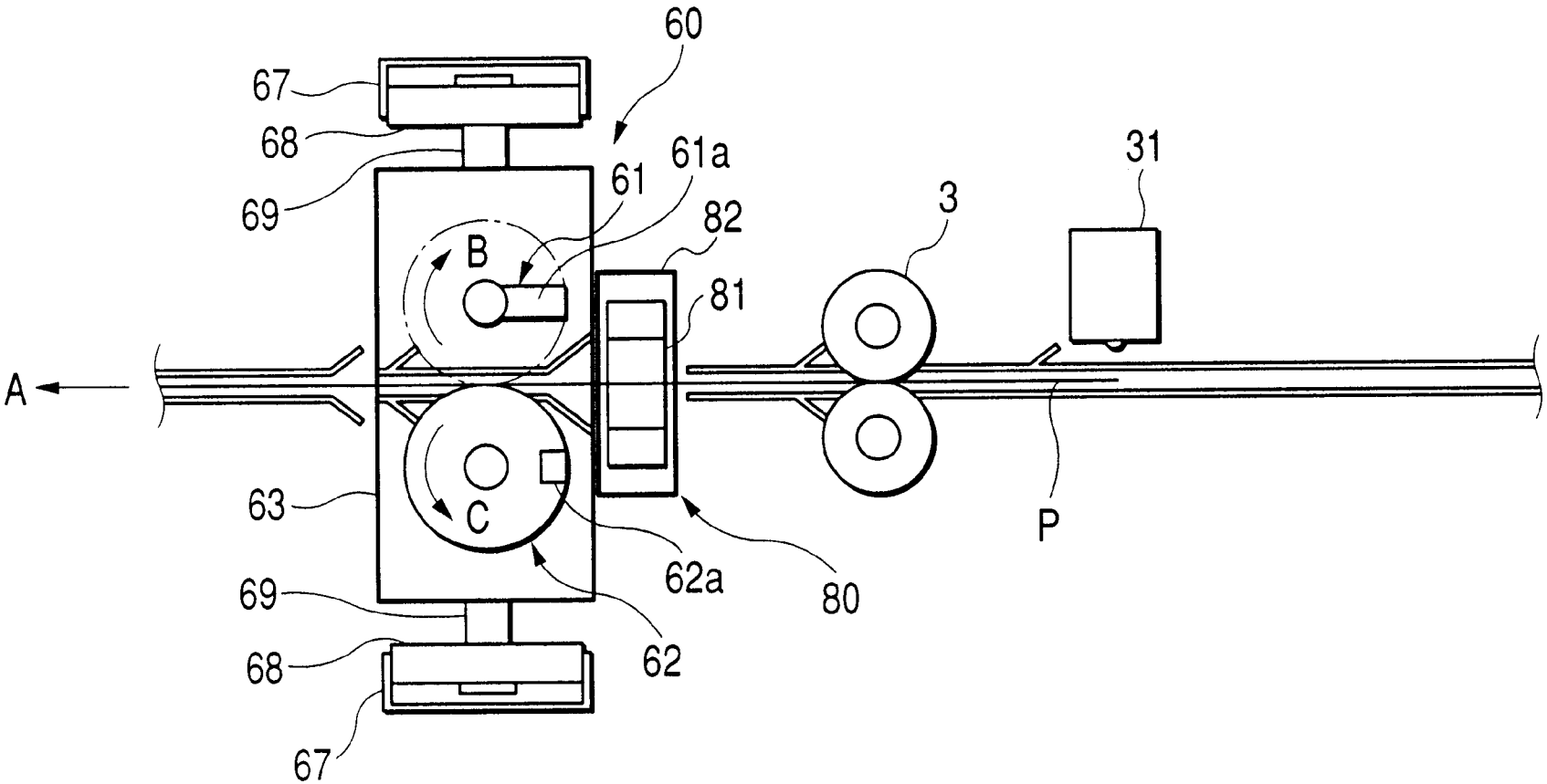
FIG. 10 is a side illustration of a punch unit.
Figure 11:
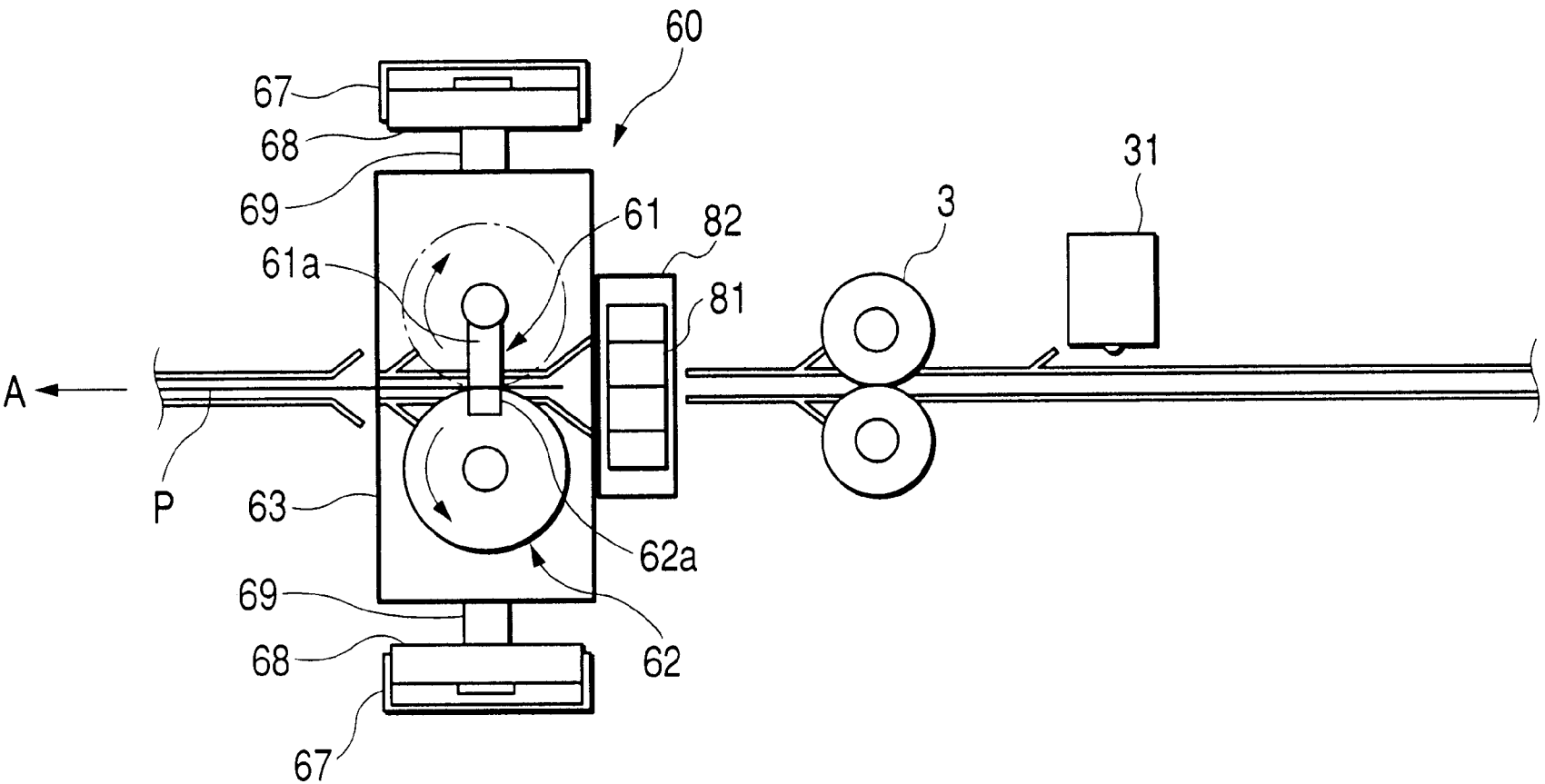
FIG. 11 is a side illustration showing the operative state of the punch unit.
Figure 12:
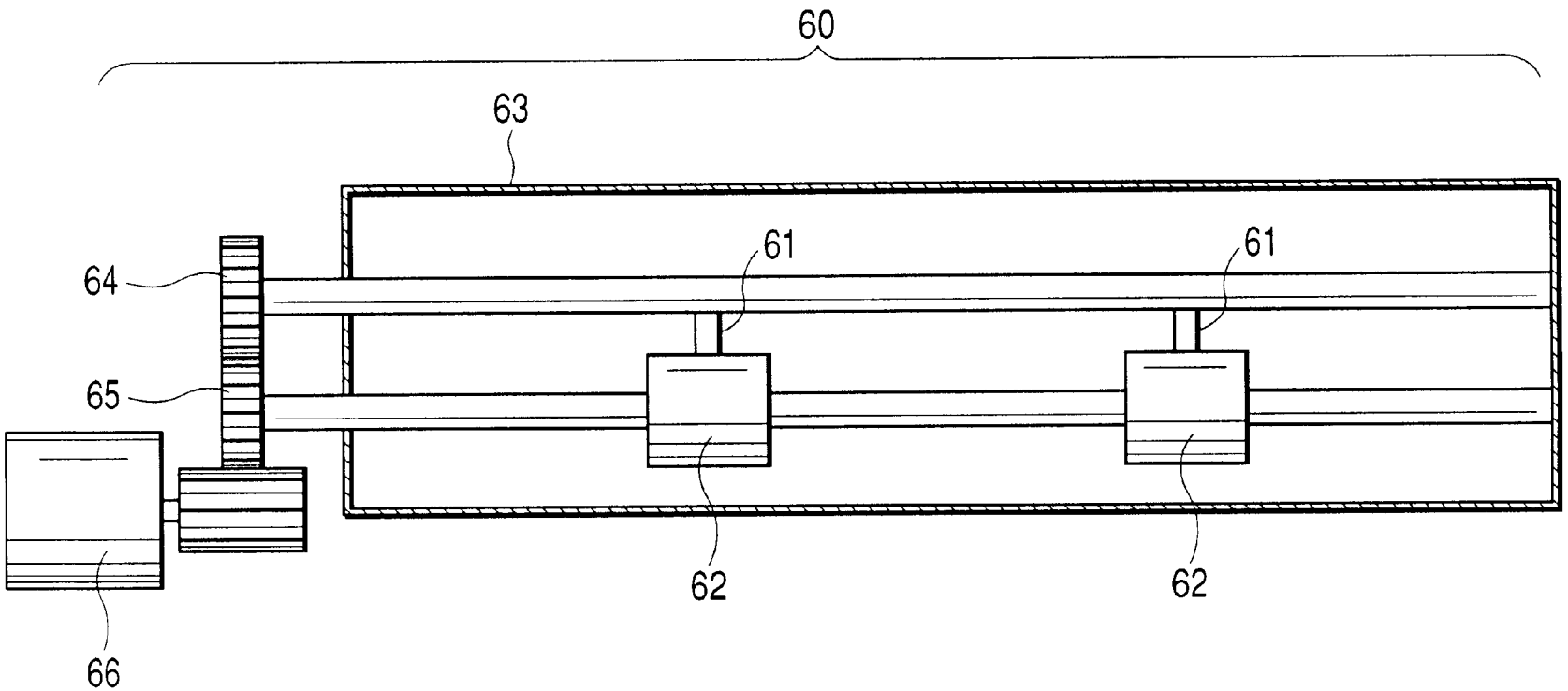
FIG. 12 is a front illustration of the punch unit.
Figure 13:
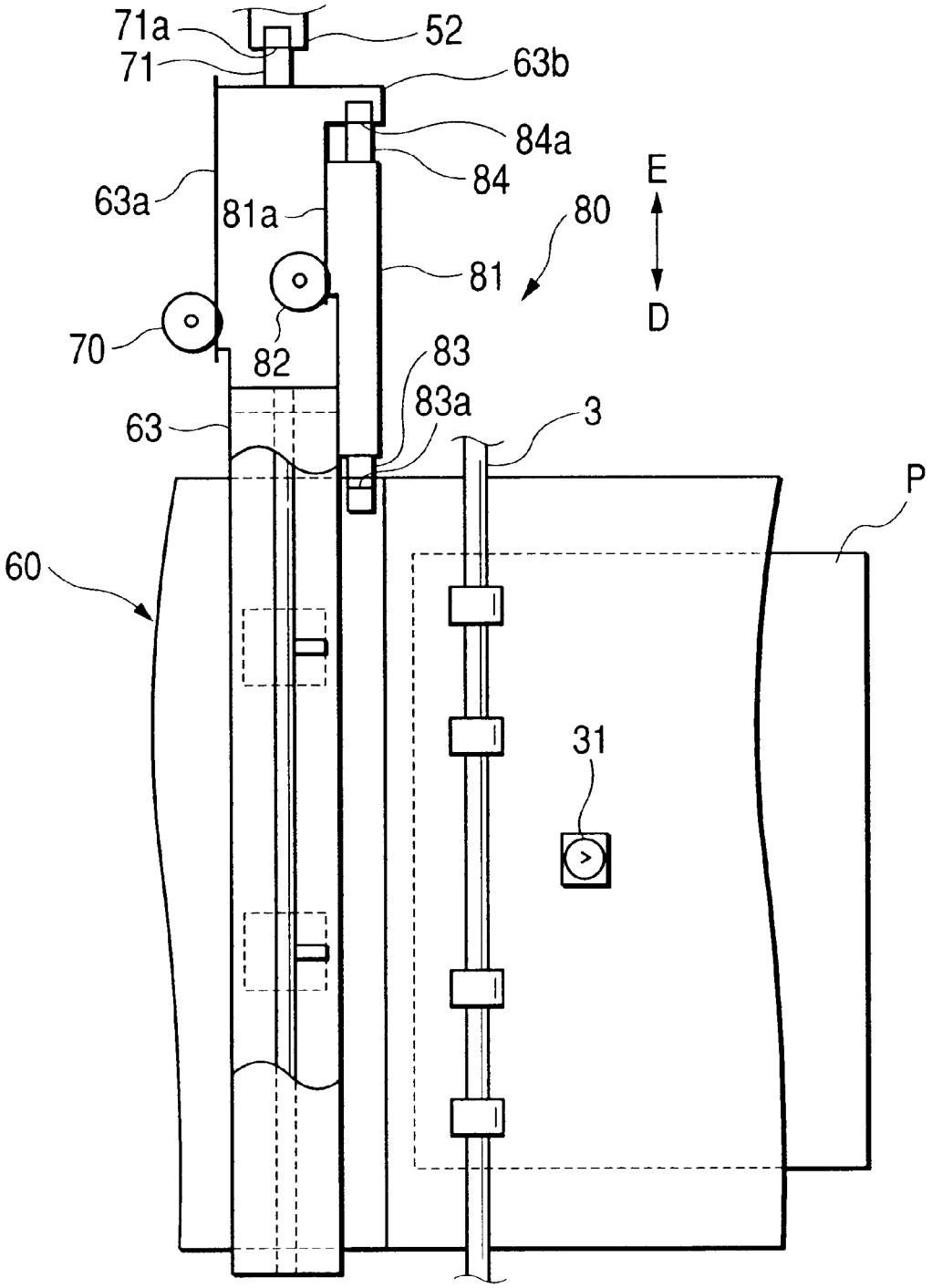
FIG. 13 is an illustration of the lateral registration sensor moving mechanism of the punch unit.
Figure 14:
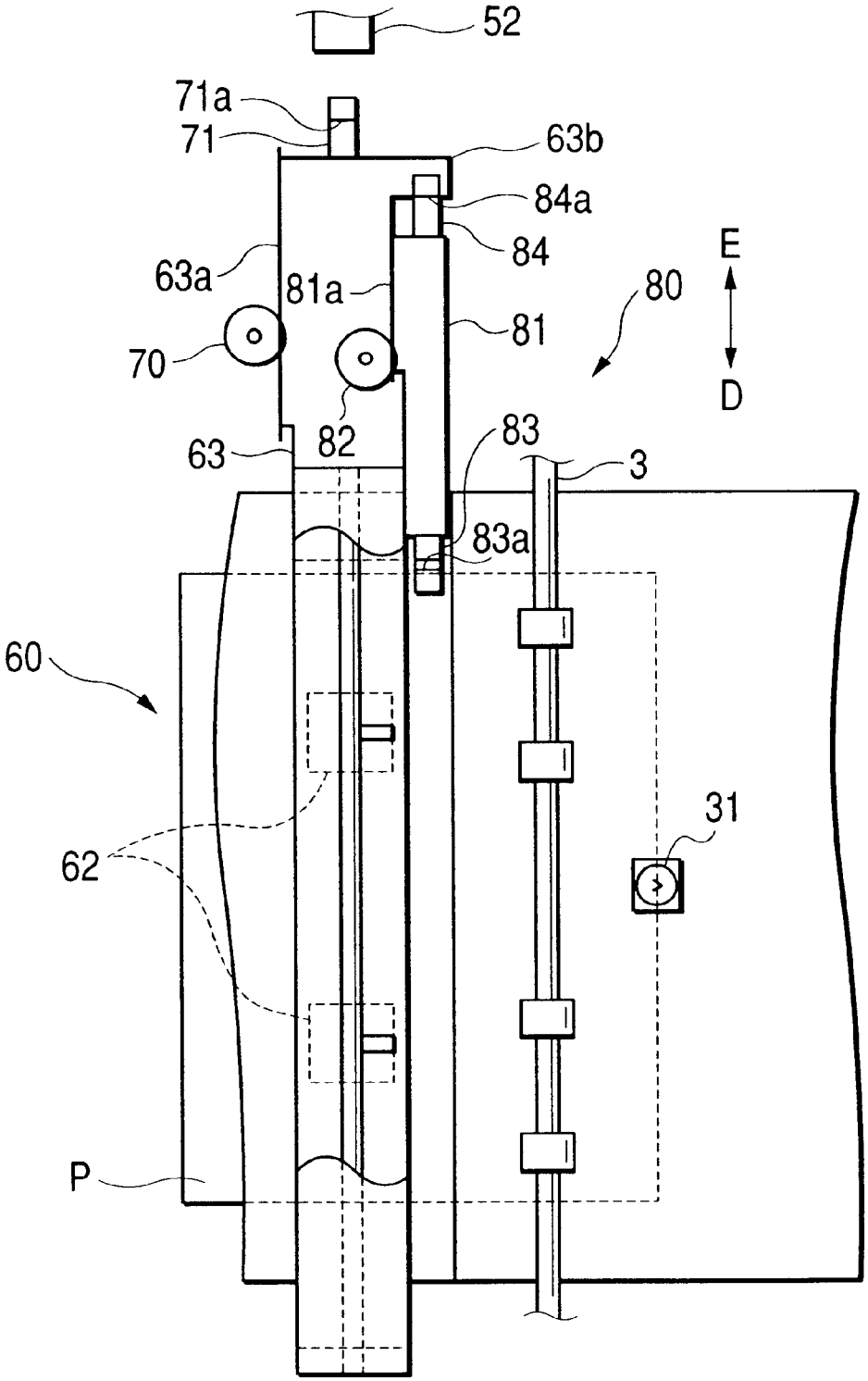
FIG. 14 is an illustration of the lateral registration sensor moving mechanism of the punch unit.

The punch unit 50 will now be described with reference to FIGS. 10 to 14. FIG. 10 is a side illustration of the punch unit, FIG. 11 is a side illustration showing the operative state of the punch unit, FIG. 12 is a front illustration of the punch unit, and FIGS. 13 and 14 are illustrations of the lateral registration sensor moving mechanism of the punch unit.

The punch unit 50, as shown in FIG. 10, are comprised of punching means 60 and lateral registration detecting means 80.

In the punching means 60, a required number of sets, herein, a pair of right and left punch members 61 and die members 62 combined with the respective punch members 61 are disposed in a casing 63 at predetermined punch intervals in the left to right direction (corresponding to the widthwise direction of the sheet, and interlocking gears 64 and 65 (see FIG. 12) on the shaft thereof are in meshing engagement with each other, and are rotatable in synchronism with each other in the directions indicated by the arrows B and C in FIG. 10 by the driving of a punching motor 66, and usually stand by at the home position of FIG. 10.

After in this state, the sheet detecting sensor 31 (see FIGS. 13 and 14) has detected the trailing end of the sheet P introduced, the punching motor 66 is driven at predetermined timing, whereby the punch protruding pieces 61*a* of the punch members 61 and the die aperture portions 62*a* of the die member 62 come into meshing engagement with each other to thereby cut holes in the corresponding portions of the sheet P. In this case, the rotational speeds of the punch members 61 and the die members 62 are made coincident with the rotational speed of the pair of transporting rollers 3 (see FIG. 1), and further with the transportation speed of the sheet P in the direction indicated by the arrow A (see FIG. 10), whereby simultaneous punching in the course of transportation is possible.

On the other hand, the punch casing 63 supporting the punch members 61 and the die members 62 has guide runners 68 lying at upper and lower positions and rotatably supported by support shafts 69, and the guide runners 68 are fitted onto each guide rails 67 parallel with the widthwise direction of the sheet P to thereby make the movement thereof in the widthwise direction possible and also, as shown in FIGS. 13 and 14, a pinion gear 70 rotatively driven by a punching means moving motor, not shown, is brought into meshing engagement with a rack gear 63*a* formed on the side of one end portion, and further, a punching means initial position detecting sensor 71 having a light receiving portion 71*a* is disposed on the aforementioned end surface.

Therefore, the punching means 60 is moved in a direction orthogonal to the direction of transportation of the sheet P, i.e., the directions indicated by the double-headed arrow D and E in FIGS. 13 and 14 (the widthwise direction of the sheet P), by the driving of the punching means moving motor, and with this movement, a punching means initial position defining portion 52 on the main body side of the apparatus can be detected by the punching means initial position detecting sensor 71, and in this case, the punching means initial position is set to a side several millimeters short of a sheet reference position corresponding to the skew feed of the sheet P or the amount of deviation of the lateral registration.

Also, the lateral registration detecting means 80 has a sensor arm 81 provided on one end portion of the punching means 60 and likewise movable in the directions indicated by the double-headed arrow D and E (the widthwise direction of the sheet P) orthogonal to the direction, indicated by the arrow A, of transportation of the sheet P by a pinion gear 82 rotatively driven by a lateral registration moving motor, not shown, being brought into meshing engagement with a rack gear 81*a* on the side edge, and on one end side of the sensor arm 81 which is close to the sheet P, there is provided a lateral registration detecting sensor 83 having a light receiving portion 83*a* for making one side edge of the sheet P movable in the directions indicated by the double-headed arrow D and E (the widthwise direction of the sheet P) orthogonal to the direction of transportation A and detecting one side edge of the sheet P, and on the other end side thereof, there is provided a lateral registration initial position detecting sensor 84 having a light receiving portion 84*a* parallel with the light receiving portion 83*a*.

Therefore, the lateral registration detecting means 80, as in the case of the punching means 60, is moved in the directions indicated by the double-headed arrow D and E (the widthwise direction of the sheet P) orthogonal to the direction of transportation A of the sheet P by the driving of the lateral registration moving motor, and with this movement, the lateral registration initial position defining portion 63*b* corresponding to the pertinent end surface of the punch casing 63 can be detected by the lateral registration initial position detecting sensor 84, and in this case, the lateral registration detecting sensor 83 can be set at a position corresponding to a selected sheet size.

When the side edge of the sheet P is to be detected, the sheet detecting sensor 31 detects the leading end of the sheet P, whereafter the punching means moving motor is driven at predetermined timing to thereby move the punching means 60 and the lateral registration detecting sensor 83, and the light receiving portion 83*a* of the lateral registration detecting sensor 83 is interrupted by the side edge of the sheet P, whereby this is detected and the punching means and the lateral registration detecting sensor are stopped. That is, thereby, the punching positions for the sheet P can be made all present on the end portion of the sheet.

Flow of the Sheet During the Nonsort Mode

A description will now be made of the flow of the sheet P in the present sheet treating apparatus.

Figure 15:
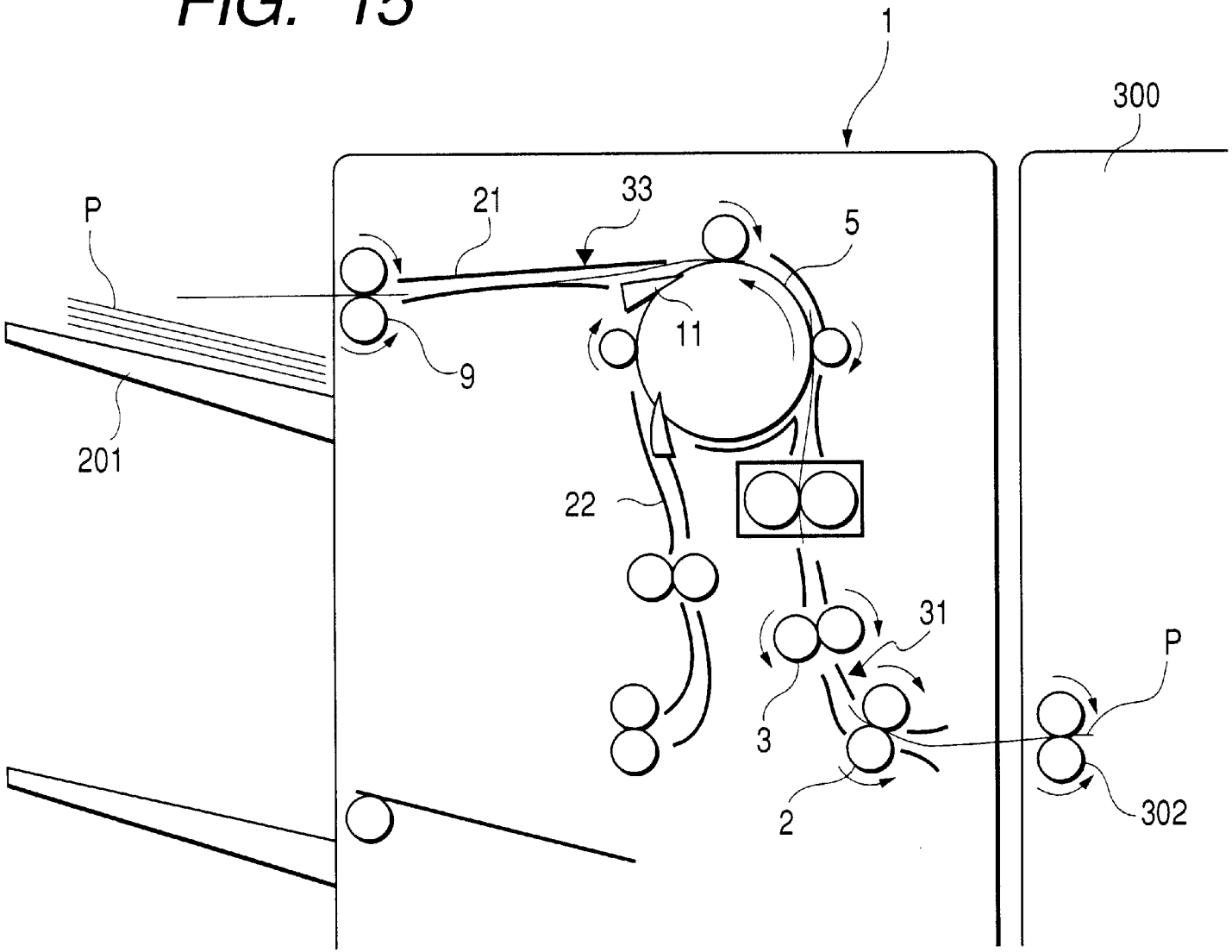
FIG. 15 shows the operation of a sheet treating apparatus portion during a nonsort mode.

When the user designates the setting of the sheet delivery mode of the image forming apparatus as non-sort, as shown in FIG. 15, the first changeover flapper 11 of the sheet treating apparatus 1 is changed over to receive the sheet P to the nonsort path 21 side, and in this state, the pair of inlet rollers 2, the pair of first transporting rollers 3 and the buffer roller 5 are rotatively driven to thereby introduce the sheet P delivered from the image forming apparatus 300 into the apparatus and transport it toward the nonsort path 21.

When the trailing end of the sheet P is detected by the nonsort path sensor 33, the pair of second delivery rollers 9 are rotatively driven at a speed suited for stacking to thereby deliver the sheet P onto the sample tray 201 and cause it to be stacked thereon.

Figure 16:
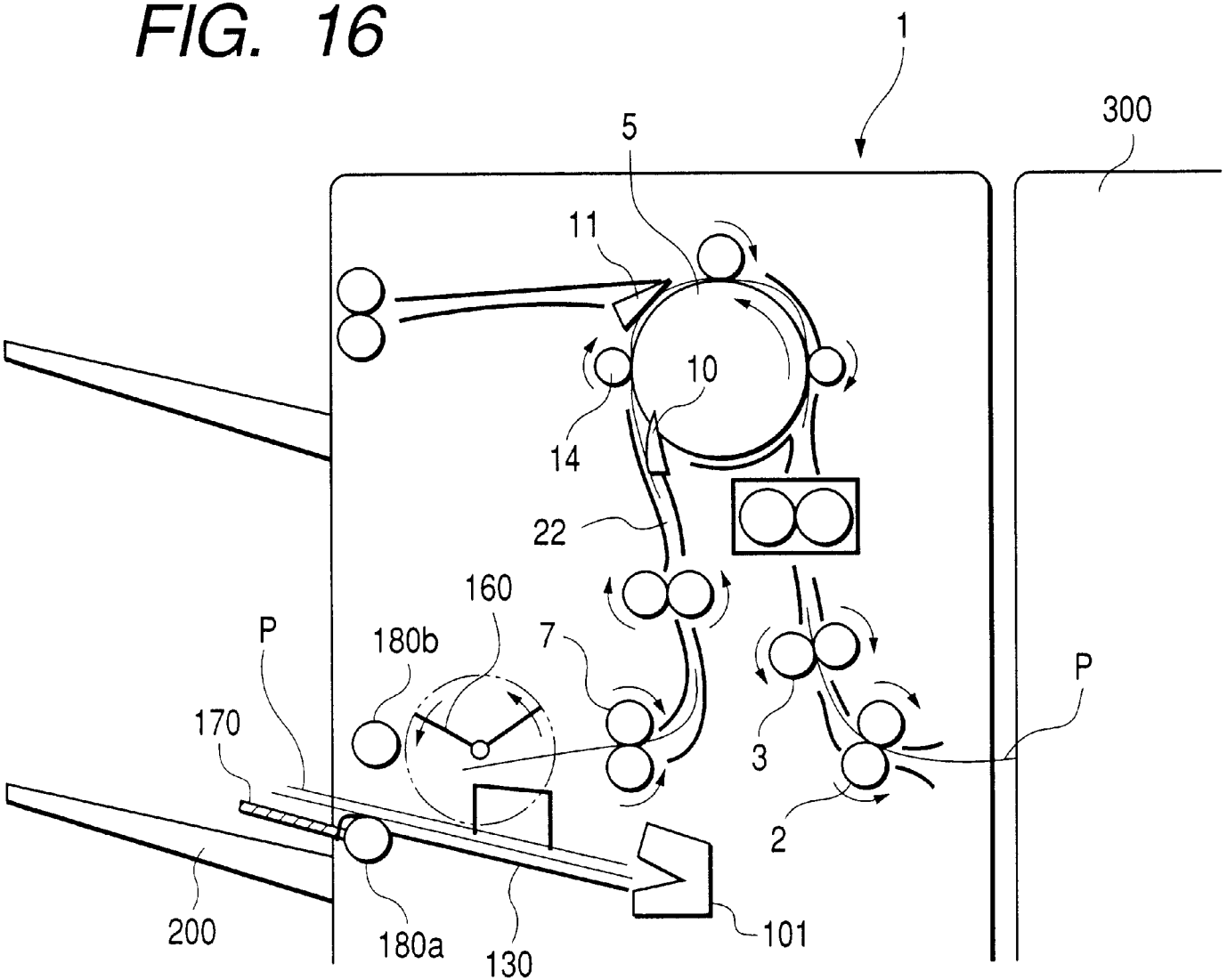
FIG. 16 shows the operation of the sheet treating apparatus portion during the staple sort mode.

When the user designates the setting of the sheet delivery mode of the image forming apparatus as staple sort, as shown in FIG. 16, the first changeover flapper 11 and second changeover flapper 10 of the sheet treating apparatus 1 are changed over to receive the sheet P to the sort path 22 side, and in this state, the pair of inlet rollers 2, the pair of first transporting rollers 3 and the buffer roller 5 are rotatively driven to thereby introduce the sheet P delivered from the image forming apparatus 300 into the apparatus and transport it toward the sort path 22.

When the trailing end of the sheet P has left the runner 14 at the last stage, the sheet P is delivered onto the treating tray 130 by the knurled belt 190 of the delivery roller 7*a* and the runner 7*b* constituting the aforedescribed pair of first delivery rollers 7. In this case, the swingable guide 150 is upwardly opened, whereby the upper delivery roller 180*b* is spaced apart from the lower delivery roller 180*a* of the pair of bundle delivery rollers 180, and a retractable tray 170 is protruded to a protruding position and therefore, even if the sheet P is thus delivered onto the treating tray 130 by the pair of first delivery rollers 7, the suspension of the leading end portion of the sheet P and the bad return thereof which will be described next will not occur and the alignment of the sheet P on the treating tray 130 will be enhanced well.

The sheet P delivered onto the treating tray 130 begins to be returned to the trailing end stopper portion 131 side by its own gravity and in addition to this, the returning action is expedited with the counter-clockwise rotation of the paddle 160 stopped at the home position. When the trailing end of the sheet P is rammed against the trailing end stopper portion 131 and the sheet P is stopped, the rotation of the paddle 160 is also stopped, and then the alignment of the sheet P by the aligning members 141 and 142 is done, whereafter by the stitching of a sheet bundle by the staple operation and the delivering operation of the pair of bundle delivery rollers 180 in the closed state of the swingable guide 150, the sheet bundle is stacked on the stacking tray 200.

Figure 17:
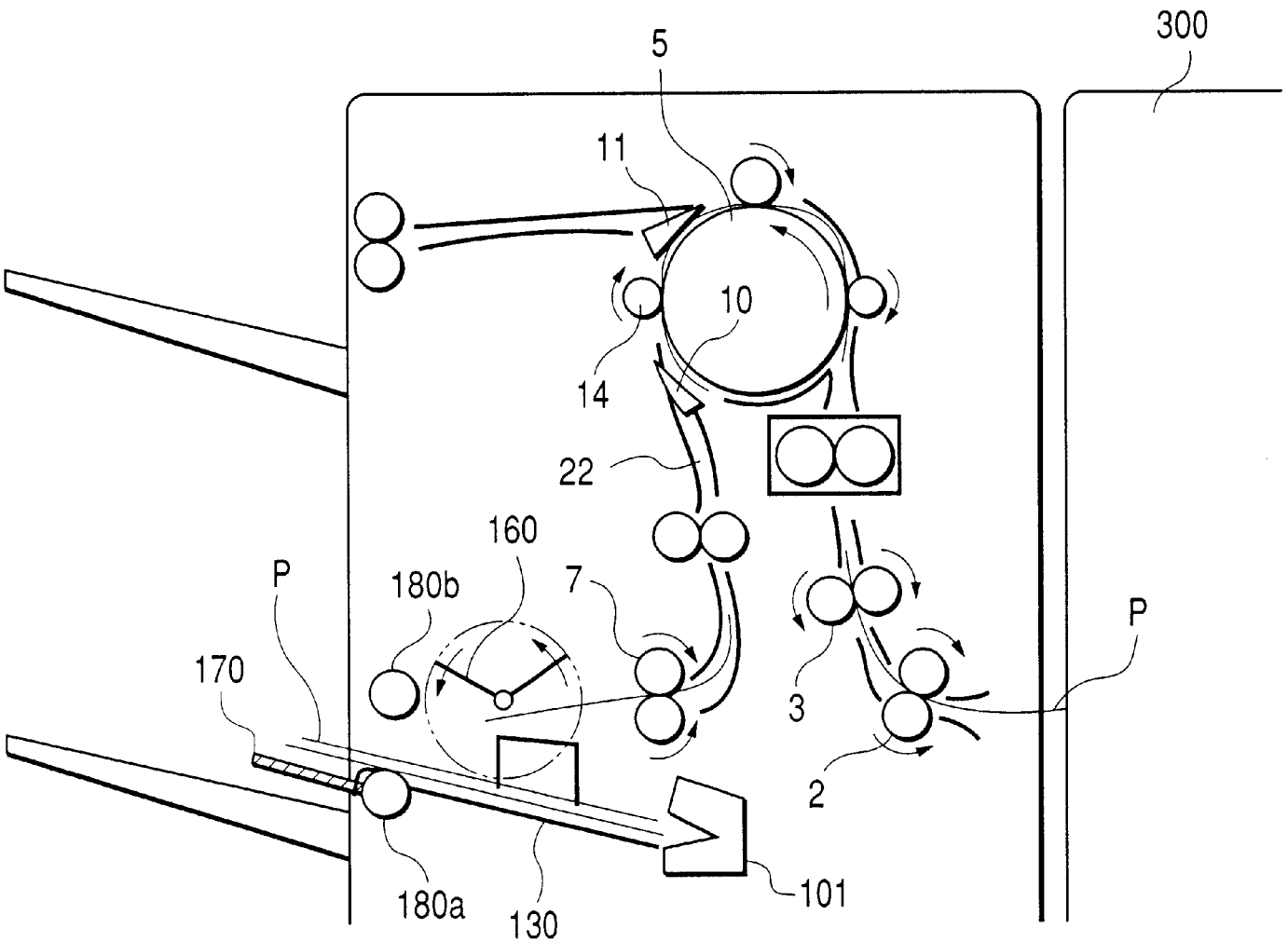
FIG. 17 shows the operation of the sheet treating apparatus portion during the staple sort mode.
Figure 18:
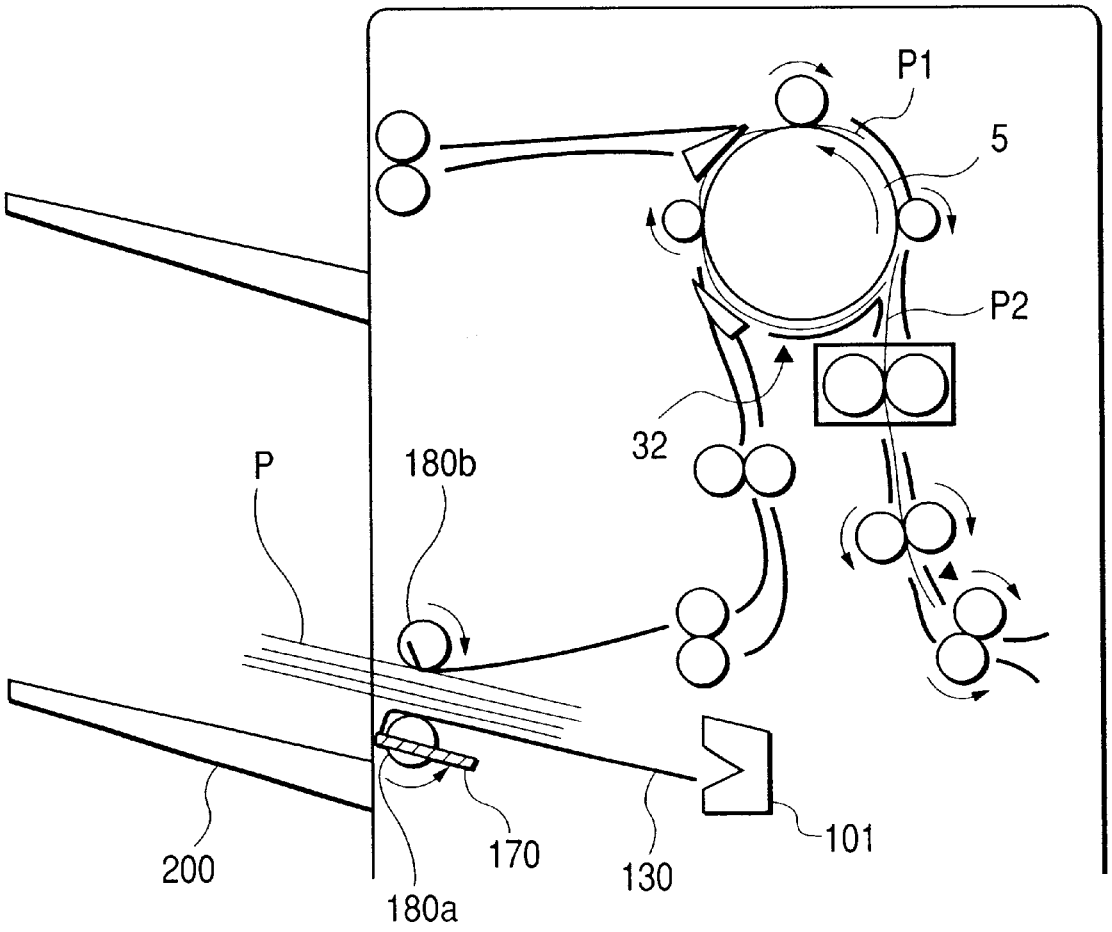
FIG. 18 shows the operation of the sheet treating apparatus portion during the staple sort mode.
Figure 19:
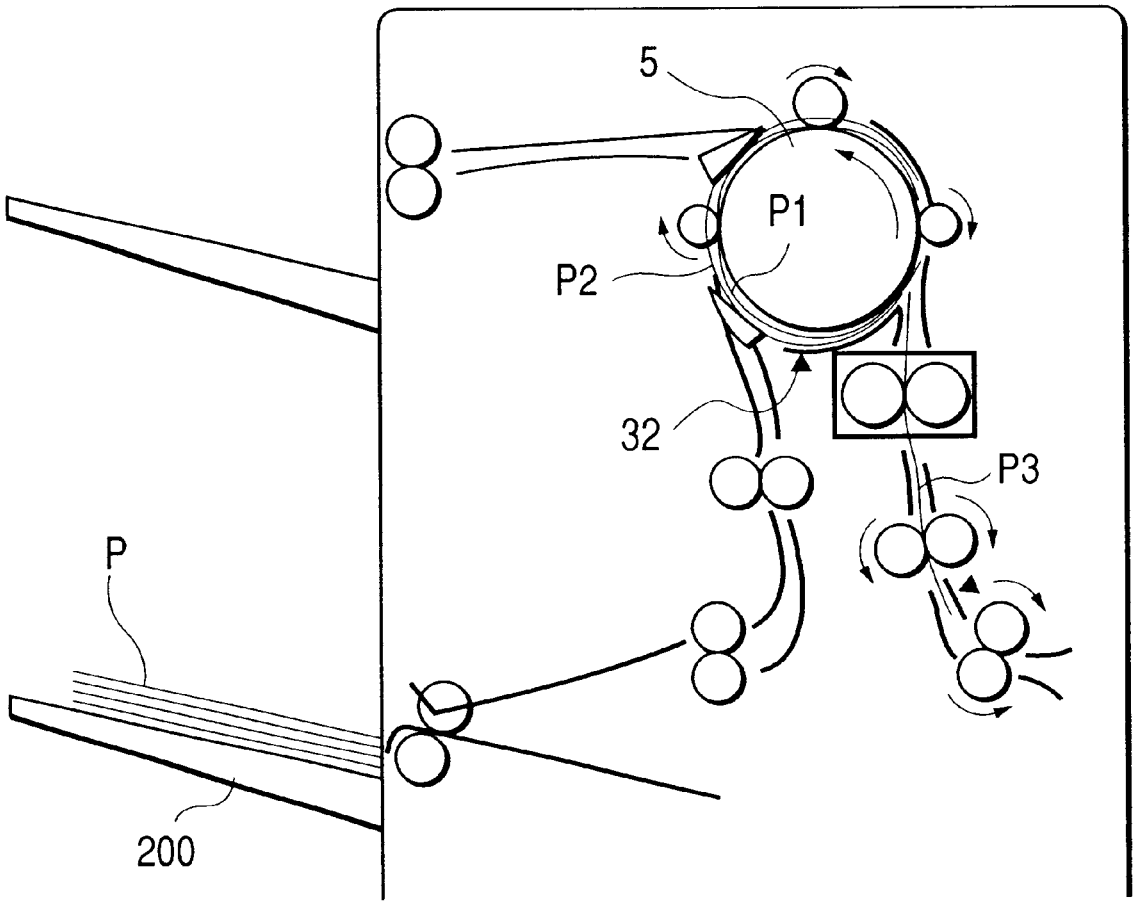
FIG. 19 shows the operation of the sheet treating apparatus portion during the staple sort mode.
Figure 20:
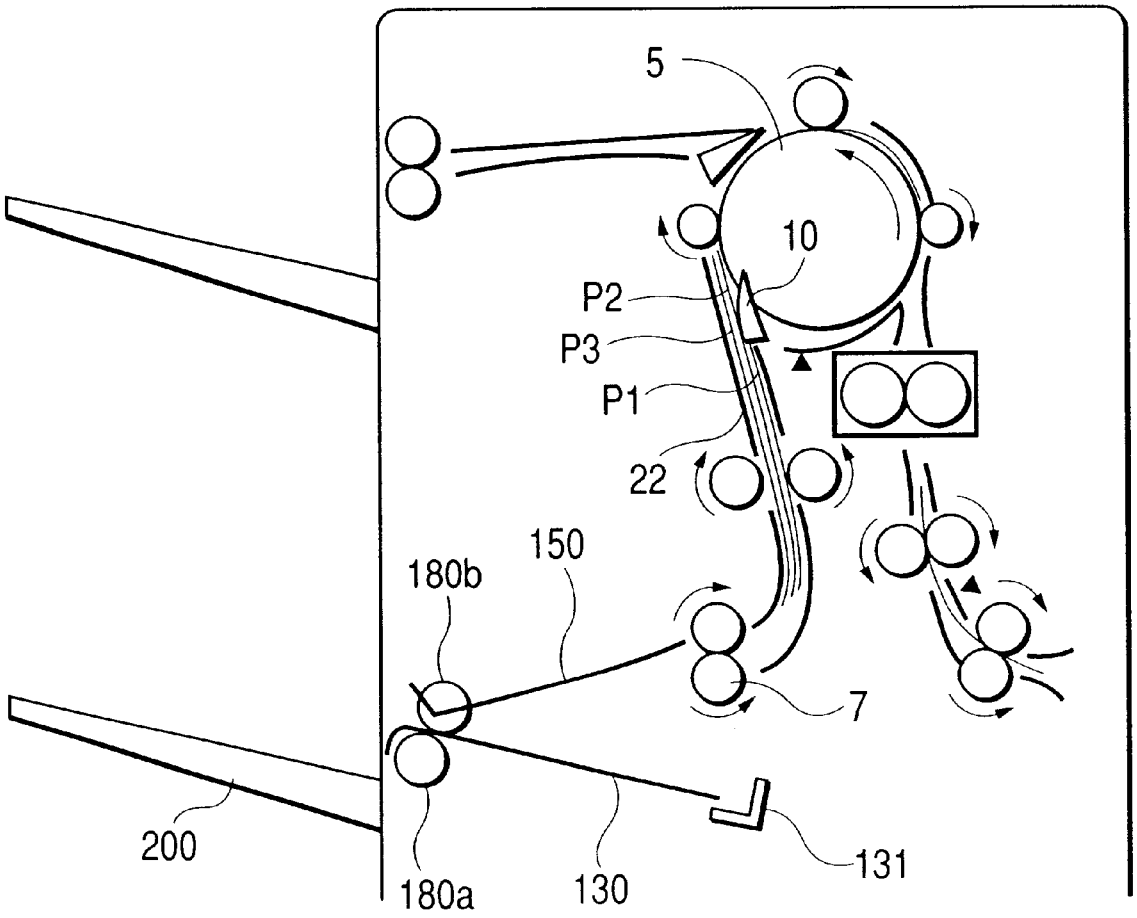
FIG. 20 shows the operation of the sheet treating apparatus portion during the staple sort mode.

On the other hand, in the meantime, the sheet P delivered from the image forming apparatus 300, as shown in FIG. 17, is twined around the buffer roller 5 by the changeover operation of the second changeover flapper 10 and is advanced by a predetermined distance from the buffer path sensor 32, whereupon it stands by due to the stoppage of the buffer roller 5, and at a point whereat the leading end of the next sheet P is advanced by a predetermined distance from the sheet detecting sensor 31, the second sheet P2 is superposed by a predetermined length earlier than the first sheet P1 with the rotation of the buffer roller 5, as shown in FIG. 18, and in this state, it is twined again around the buffer roller 5, as shown in FIG. 19, and further the third sheet P3 is likewise twined around the buffer roller 5, whereafter the second changeover flapper 10 is again changed over, whereby the three sheets P1, P2 and P3 superposed one upon another with their leading ends shifted by predetermined lengths as shown in FIG. 20 are transported to the sort path 22.

Figure 21:
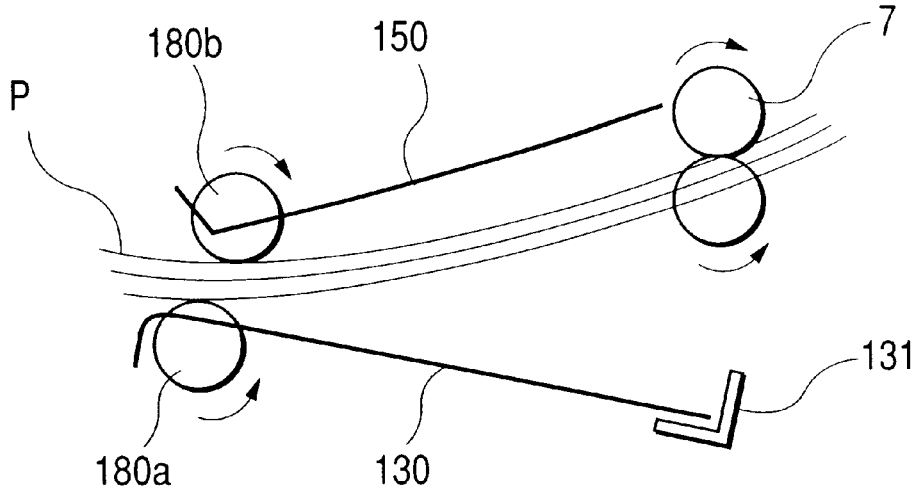
FIG. 21 shows the operation of the sheet treating apparatus portion during the staple sort mode.
Figure 22:
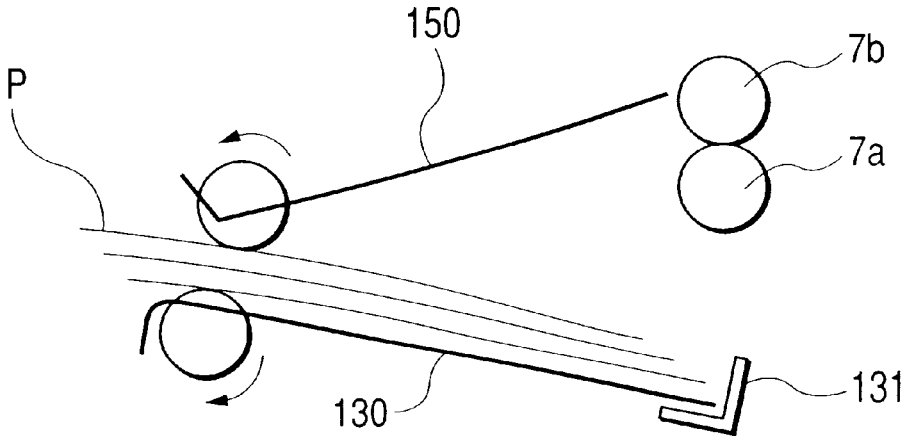
FIG. 22 shows the operation of the sheet treating apparatus portion during the staple sort mode.
Figure 23A:
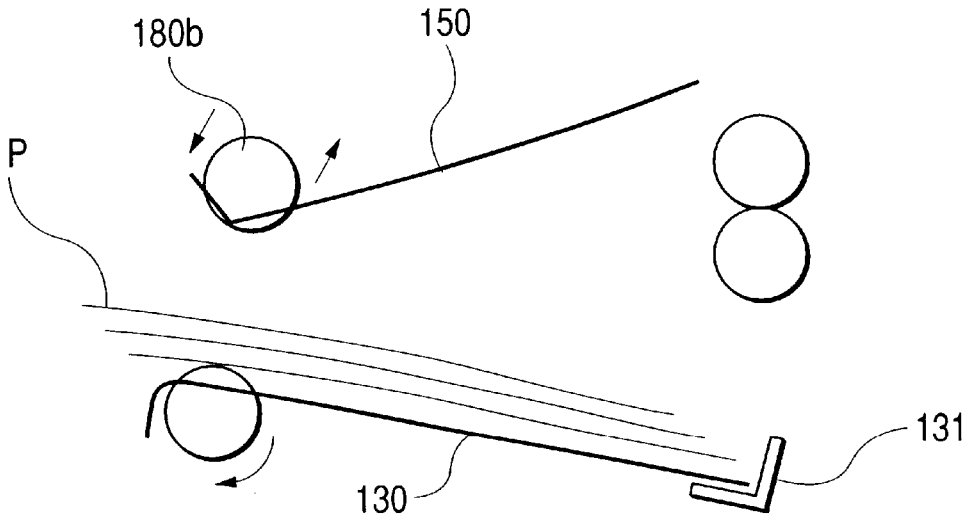
FIGS. 23A and 23B show the operation of the sheet treating apparatus portion during the staple sort mode.
Figure 23B:
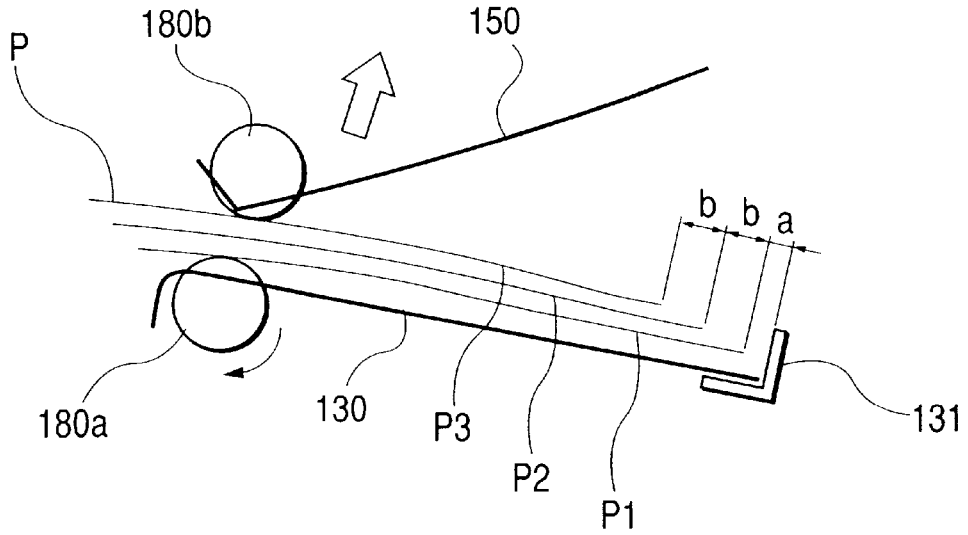

At this point of time, the bundle delivery operation for the preceding sheet bundle is terminated and herein, with the swingable guide 150 remaining closed as shown in FIG. 21, the pair of bundle delivery rollers 180*a* and 180*b* being forwardly rotated in the direction of delivery once receive the three sheets P1, P2 and P3 transported thereto. Then, at a point of time whereat as shown in FIG. 22, the trailing ends of the three sheets P have left the pair of first delivery rollers 7*a* and 7*b* and have contacted with the surface of the treating tray 130, the pair of bundle delivery rollers 180*a* and 180*b* are reversely rotated so as to return the received three sheets P, and before the trailing ends of the three sheets P are rammed against the surface of the trailing end stopper portion 131, for example, at a point of time whereat as shown in FIG. 23B, the three sheets P having deviation intervals "b" among them have become close to one another leading as interval "a" between their trailing ends and the surface of the trailing end stopper portion 131, the swingable guide 150 is opened as shown in FIG. 23B to thereby space the pair of bundle delivery rollers 180*a* and 180*b* apart from each other. Then, the fourth and subsequent sheets P, as in the operation for the first sheet, pass the sort path 22 and are delivered onto the treating tray 130. The third and subsequent sheets repeat the same operation as that for the second sheet, and a set number of sheets are stacked on the stacking tray 200, thus terminating the treatment.

As previously described, in the superposition transportation of the plurality of sheets, each sheet P is offset in the direction of transportation. That is, the sheet P2 is offset to the downstream side relative to the sheet P1, and the sheet P3 is offset to the downstream side relative to the sheet P2. Here, the amount of offset between the sheets P and the roller pair spacing (elevating) start timing of the swingable guide 150 are concerned with the alignment time of the sheets P by the returning speed between the pair of bundle delivery rollers 180*a* and 180*b*. That is, it is determined by the treating capacity of the image forming apparatus 300, and in the present embodiment, at the transportation speed 750 mm/s of the sheet P, the amount of offset "b"=20 mm or so and the bundle delivery roller returning speed 500 mm/s, the spacing start position for the bundle delivery rollers has its timing set at a point of time whereat the trailing end of the sheet P1 reaches about 40 mm (the value of the interval "a") short of a point at which it is rammed against the surface of the trailing end stopper portion 131.

Sort Mode

Figure 24:
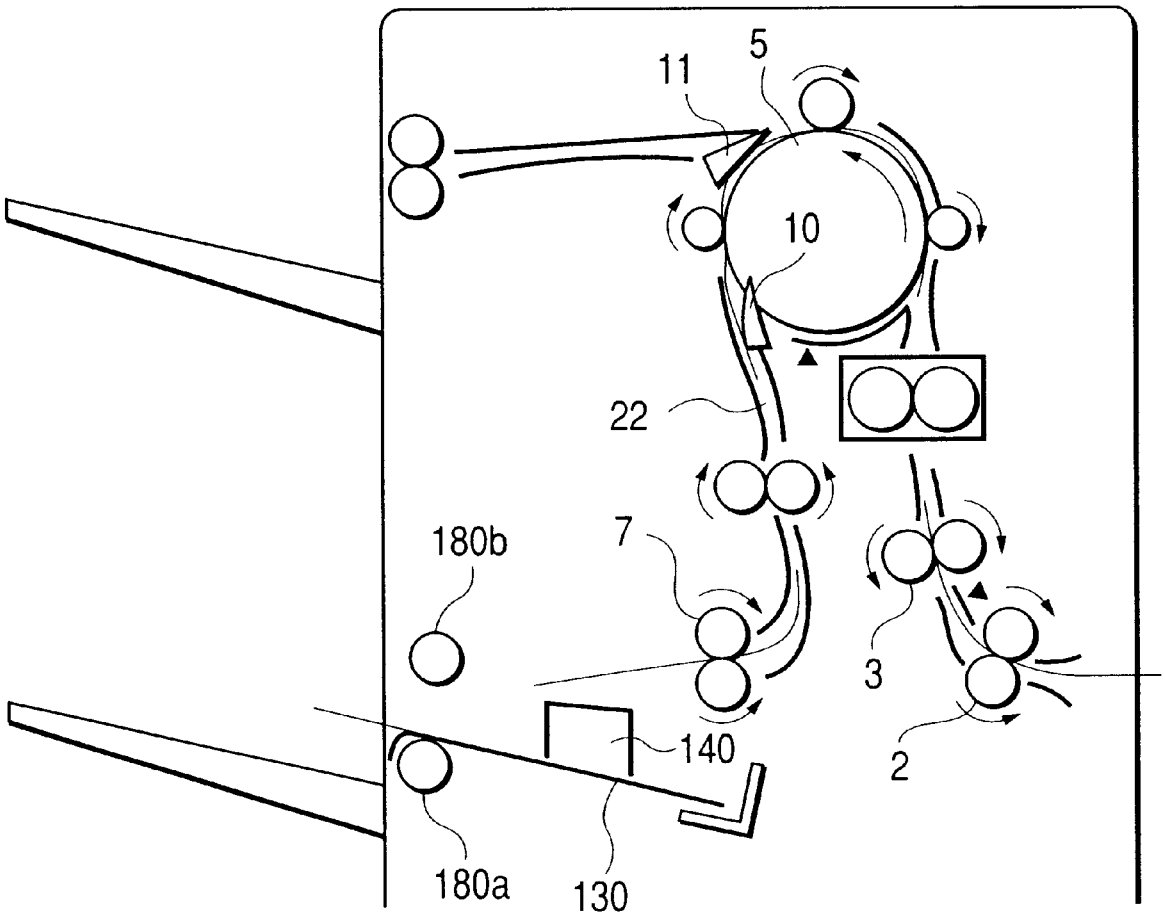
FIG. 24 shows the operation of the sheet treating apparatus portion during the sort mode.
Figure 25:
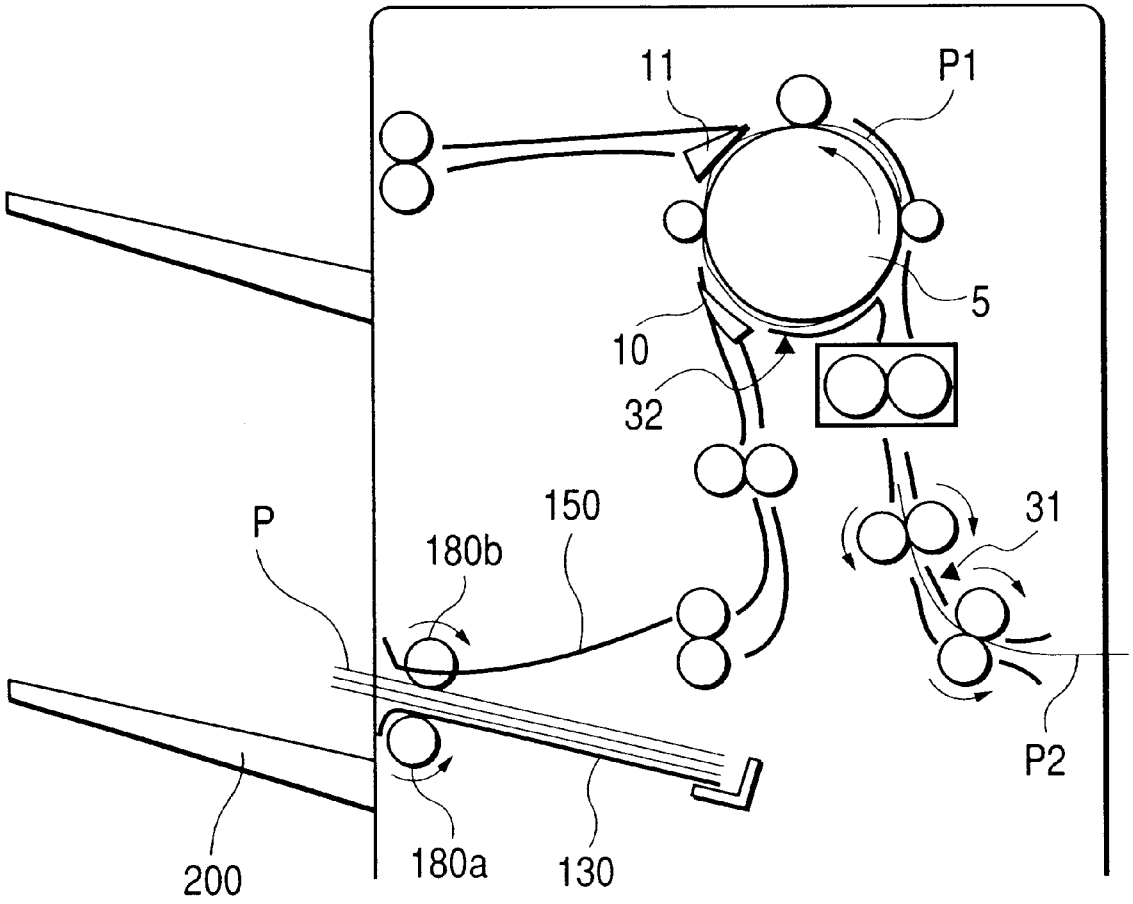
FIG. 25 shows the operation of the sheet treating apparatus portion during the sort mode.

The sort mode will now be described. The user sets an original on the original reading portion 400 of the image forming apparatus 300, and thereafter designates the sort mode on an operating portion, not shown, and switches on a start key, not shown. Thereby, the pair of inlet rollers 2 and the pair of first transporting rollers 3, as shown in FIG. 24, transport the sheets P and stack them on the treating tray 130 as in the case of the staple sort mode. The aligning means 140 stacks a few sheets on the treating tray 130 while aligning the sheet bundle on the treating tray 130, whereafter as shown in FIG. 25, the swingable guide 150 lowers in the closing direction and bundle-transports a bundle of a few sheets.

The sheet P transported next is twined around the buffer roller 5 as in the case of the staple sort mode, and is delivered onto the treating tray 130 after the termination of the bundle delivery. It is desirable as the result of an experiment that the number of sheets in the bundle of a few sheets bundle-delivered be 20 sheets or less. This number of sheets is set so as to become a number which satisfies the relation that the number of originals≧the number of sheets bundle-delivered≦20 sheets.

Consequently, if the number of sheets to be bundle-delivered is set to 5 when the program is prepared, 4 sheets at a time are bundle-delivered when the number of originals is 4. Also, if the number of originals is 5 or more, e.g. 14, the originals are divided into 5 sheets+5 sheets+4 sheets, and these are respectively aligned and bundle-delivered.

Figure 26:
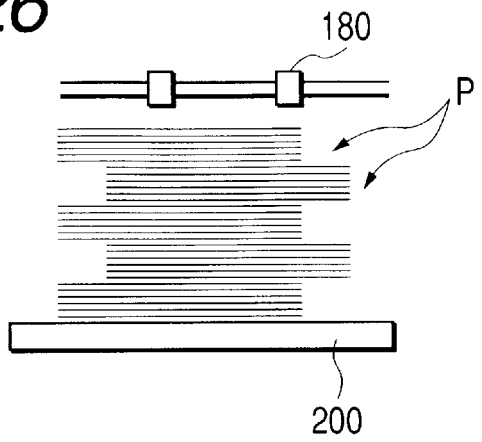
FIG. 26 shows the operation of the sheet treating apparatus portion during the sort mode.

When the bundle delivery of the first bundle is all completed, the aligning member 141 on the left side is moved with the aligning member 142 on the right side to thereby offset the aligned position of the second bundle relative to the aligned position of the first bundle. The second bundle is aligned at the aforementioned offset position, and is bundle-delivered by a few sheets at a time like the first bundle. When the bundle delivery of the second bundle is completed, the aligning members 141 and 142 are returned to their positions at which they aligned the preceding first bundle, and align the third bundle. In this manner, as shown in FIG. 26, the bundle delivery of all the set number of bundles is completed while the sheet bundles are shifted relative to one another.

Aligning and Stapling Operations

Figure 27:
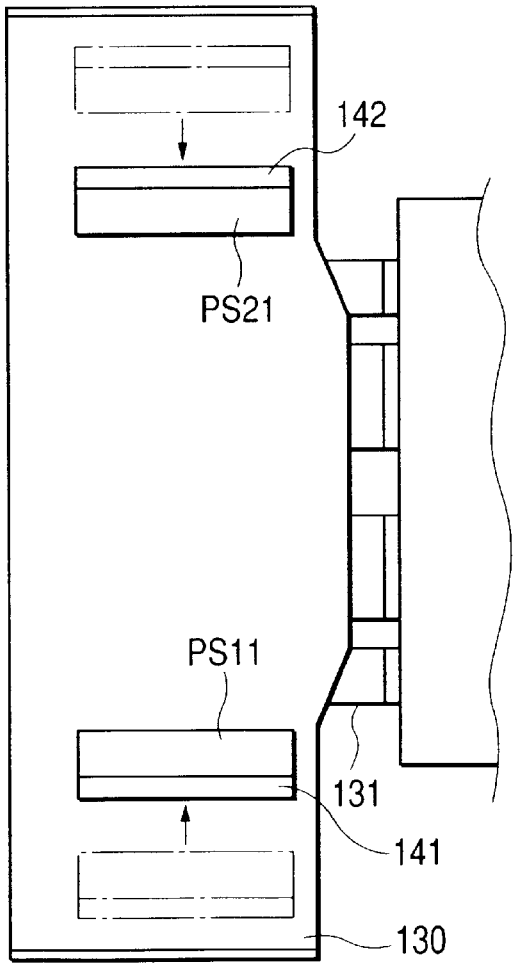
FIG. 27 is a plan view of the treating tray showing the sheet bundle aligning operation.

The operations of aligning and stapling the sheets will now be described. First, when there is no sheet P on the treating tray 130, that is, when the first sheets P (three sheets) of that job are to be delivered, as shown in FIG. 27, the left (lower as viewed in FIG. 27) and right (upper as viewed in FIG. 27) aligning members 141 and 142 which have so far stood by at the home positions are moved in advance to positions PS11 and PS21, respectively, somewhat outwardly escaped relative to the width of the sheets P delivered.

Figure 28:
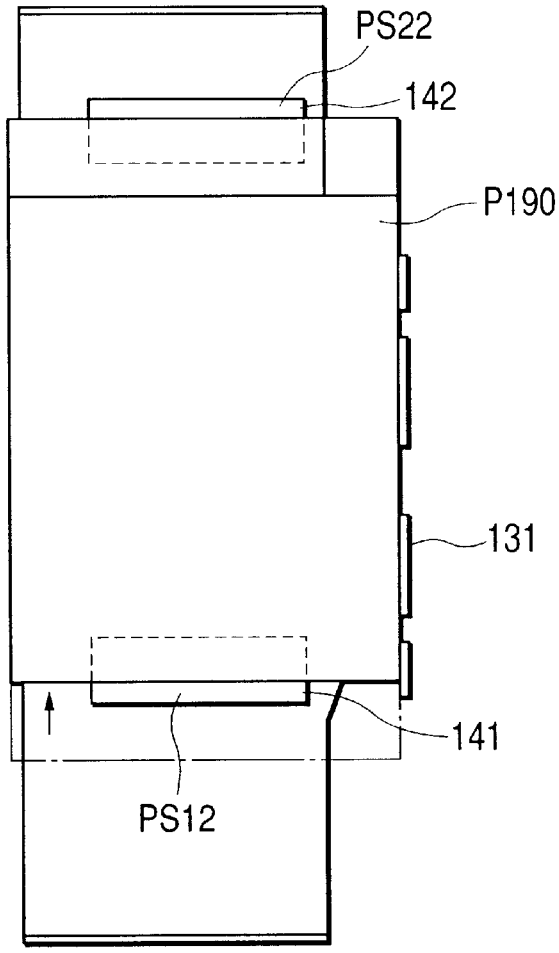
FIG. 28 is a plan view of the treating tray showing the sheet bundle aligning operation.
Figure 29:
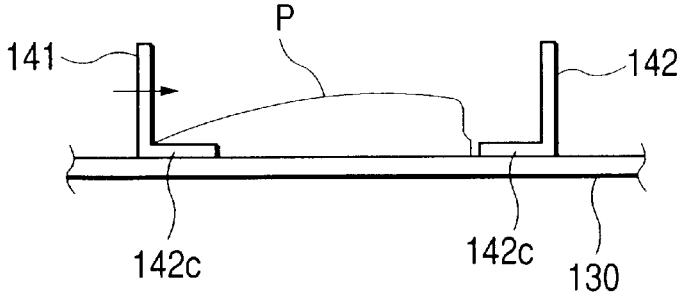
FIG. 29 is a plan view of the treating tray showing the sheet bundle aligning operation.

As described above, when the three sheets P have their trailing ends supported by the trailing end stopper portion 131 and their undersides supported by the supporting surfaces 141*c* and 142*c* (see FIG. 29) of the aligning members 141 and 142, respectively, the aligning members 141 and 142 are moved to positions PS12 and PS22, respectively, as shown in FIG. 28, and move and align the sheets P to a first aligning position P190. Thereafter, one aligning member 141 is returned to and stands by at the position PS11 in preparation for a sheet P delivered subsequently, and when the sheet delivery is done, it is again moved to the position PS12, where it moves and align this delivered sheet P to the first aligning position P190. At this time, the other aligning member 142 continues to stop at the position PS22 to thereby perform its role as the reference position. The above-described operation is continued until it reaches the last sheet P in that bundle. Accordingly, the aligning operation is done thus and therefore, it never happens that as shown, for example, in FIG. 29, the end portion of the moving sheet P collides against the end portion or the like of the supporting surface 142*c* and is buckled.

The first sheet bundle which has been aligned is stapled as required, and is bundle-delivered and transported to and stacked on the stacking tray 200.

Figure 30:
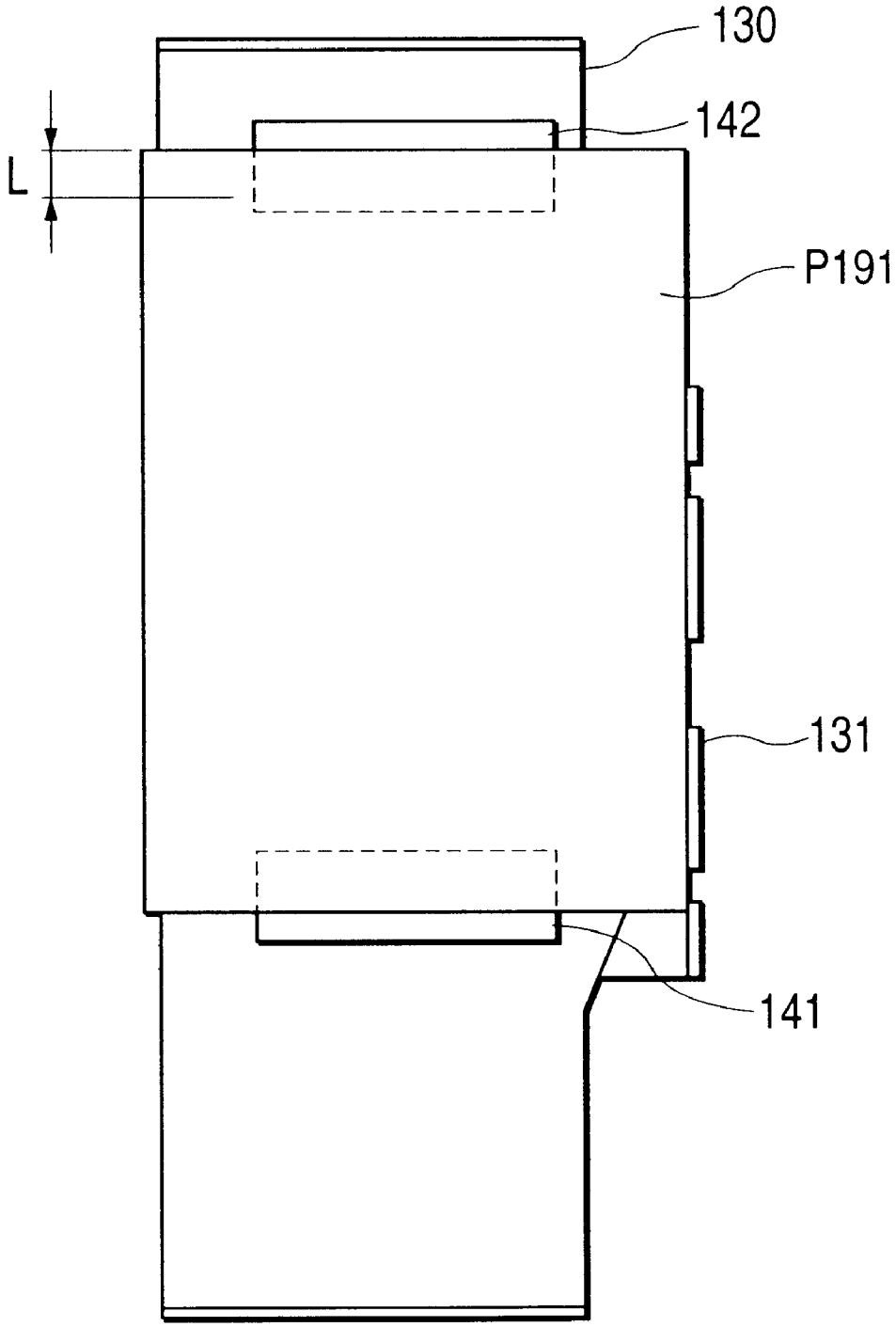
FIG. 30 is a plan view of the treating tray showing the sheet bundle aligning operation.

Subsequently, the sheets P (three sheets) of the second bundle are delivered to the treating tray 130, and at this time, the aligning members 141 and 142 are standing by at the positions PS11 and PS21 as for the first bundle, but their aligning position shifts to a second aligning position P191. This second aligning position P191, as shown in FIG. 30, lies rightwardly (upwardly as viewed in FIG. 30) by a predetermined amount L relative to the first aligning position P190.

That is, thereafter, bundle stacking is effected on the stacking tray 200 while the aligning position is changed for each sheet bundle, and the sort stacking by an offset amount L becomes possible.

The offset amount L may be varied between the sort mode and the staple mode. For example, during the staple mode, the offset amount may be an amount L1 (about 15 mm) which can prevent the overlapping of staples for adjacent bundles after the bundle stacking, and during the sort mode, it may be an amount L2 (about 20 to 30 mm) by which the visibility of bundle discrimination is improved, whereby the alignment movement distance during the staple mode can be shortened to thereby achieve an improvement in the treating speed.

Next, during the staple mode, the stapler 101 stands by in advance at a desired clinch position for the aligned sheet bundle, and staples at a point of time whereat the delivery and alignment of the last sheet P in the bundle have been completed. As previously described, the aligning position for sheet bundles changes correspondingly to the offset amount L for each bundle, and in conformity therewith, the stapler 101 is also moved.

Also, the construction in which the stapler 101 is reoriented and moved correspondingly to the stitching mode (the oblique stitching of the left side edge portion, the oblique stitching of the right side edge portion and two-point stitching) has already been described. In this construction, however, the range in which the same staple posture (horizontal and each inclined state) can be maintained is limited and further, there are numerous sheet widths over which stapling is effected, and there are cases where for different binding modes, stapling cannot be effected at the same aligning position and therefore, the first and second aligning positions P190 and P191 may be changed correspondingly to each stitching mode.

In the present embodiment, the stitching treatment is effected to the sheets being stacked on the first stacking tray means and therefore description has been made of the movement of the aligning means in the direction perpendicular to the sheet feeding direction and the paddle means for more rapid alignment, but a similar effect can also be obtained in a simple system, that is, when use is not made of the stitching means, the aligning means and the paddle means.

Since the present invention is constructed as described above, the endless belt member tries to feed the sheets with a substantially constant force irrespective of the stack height of the sheet bundles and therefore, it is possible to eliminate the inconvenience during stacking that the sheet does not arrive at the trailing end stopper portion of the stacking tray means or is buckled or runs upon the stopper portion.

Accordingly, in case of the sheet aligning treatment by the aligning means for carrying out such treatment as a stitching process on the stacking tray means, the endless belt member can be deformed so as not to contact with the sheet by the pulling operation of the traction means for the endless belt member, whereby the smoothness of the widthwise alignment movement of the sheet can be achieved, and the endless belt member tries to feed the sheets with a substantially constant force irrespective of the stack height of the sheet bundles and therefore, it is possible to eliminate the inconvenience during stacking that the sheet does not arrive at the trailing end stopper portion of the stacking tray means or is buckled or runs upon the stopper portion.

Also, the traction means can be made to perform an upwardly pulling operation relative to the stacking surface of the stacking tray, whereby at a smaller movement stroke, the endless belt member can be retracted from the sheet, and the time required for control becomes short, and productivity can be improved or the size of the apparatus can be made small.

Further, provision is made of the height detecting means for detecting the height of the sheet bundles stacked on the stacking tray means, and on the basis of information detected by this height detecting means, the amount of traction is determined, whereby it becomes possible to more accurately uniformize the amount of contact between the sheet bundle and the endless belt member, and further the feeding force, and the inconvenience during stacking can be eliminated.

What is claimed is:

1. A sheet treating apparatus comprising:

stacking tray means having a surface for receiving and stacking sheets thereon and a stopper portion for regulating ends of the sheets stacked thereon;

a delivery rotary member for delivering a sheet to said stacking tray means;

an endless belt member for contacting with and acting on an upper surface of a delivered sheet on said stacking tray means, and feeding the delivered sheet so as to pull an end of the delivered sheet into said stopper portion;

traction means for pulling a portion of said endless belt member in a predetermined direction; and a controller for controlling an amount of movement of said traction means in conformity with information of a height of the sheets stacked on said stacking tray means.

2. A sheet treating apparatus according to claim 1, wherein said stacking tray means is inclined so that a downstream side thereof in a delivery direction of the delivered sheet becomes higher, and the delivered sheet is switched back with a movement direction thereof changed over to a return direction, and said stopper portion is provided on a downstream side in the return direction.

3. A sheet treating apparatus according to claim 2, wherein said endless belt member is supported by a portion of an inner peripheral surface of said endless belt member, said endless belt member being twined around said delivery rotary member and being rotated with said delivery rotary member.

4. A sheet treating apparatus according to claim 1, further comprising:

paddle means for feeding the delivered sheet so as to pull the end of the delivered sheet into said stopper portion; and aligning means for aligning the delivered sheet pulled toward said stopper portion in a direction orthogonal to a pull-in direction of the delivered sheet, wherein during operations of said paddle means and said aligning means, said endless belt member is pulled by said traction means to thereby retract said endless belt member to a position in which said endless belt member does not hamper the operations of said paddle means and said aligning means.

5. A sheet treating apparatus according to claim 1, further comprising height detecting means for detecting the height of the sheets stacked on said stacking tray means, and wherein said traction means is operated in conformity with the detected height.

6. A sheet treating apparatus according to claim 1, wherein a number of the sheets stacked on said stacking tray means is counted to thereby calculate the height of the sheets stacked on said stacking tray means, and said traction means is operated in conformity with the calculated height.

7. A sheet treating apparatus according to claim 1, wherein when said traction means is operated and said endless belt member is pulled thereby, said endless belt member is moved substantially upwardly from said stacking tray means.

8. A sheet treating apparatus according to claim 7, wherein said traction means includes a floating runner rotatable by a movement of an inner peripheral surface of said endless belt member contacting with said floating runner, and moving means for moving said floating runner in the predetermined direction.

9. A sheet treating apparatus according to claim 1, wherein said controller controls the amount of movement of said traction means once for each delivered sheet so as to maintain a sheet feeding force of said endless belt member substantially constant irrespective of the height of the stacked sheets.

10. A sheet treating apparatus according to claim 1, wherein said controller controls the amount of movement of said traction means once for a number of delivered sheets so as to maintain a sheet feeding force of said endless belt member substantially constant irrespective of the height of the stacked sheets.

11. An image forming apparatus comprising:

image forming means for forming an image on a sheet; and a sheet treating apparatus for delivery-treating the sheet on which an image has been formed, said sheet treating apparatus including:

stacking tray means having a surface for receiving and stacking sheets thereon and a stopper portion for regulating ends of the sheets stacked thereon;

a delivery rotary member for delivering a sheet to said stacking tray means;

an endless belt member for contacting with and acting on an upper surface of the delivered sheet on said stacking tray means, and feeding the delivered sheet so as to pull an end of the delivered sheet into said stopper portion;

traction means for pulling a portion of said endless belt member in a predetermined direction; and a controller for controlling an amount of movement of said traction means in conformity with information of a height of the sheets stacked on said stacking tray means.

12. An image forming apparatus according to claim 11, wherein said stacking tray means is inclined so that a downstream side thereof in a delivery direction of the delivered sheet becomes higher, and the delivered sheet is switched back to return with a movement direction thereof changed over, and said stopper portion is provided on a downstream side in the direction of return of the sheet.

13. An image forming apparatus according to claim 12, wherein said endless belt member is supported by a portion of an inner peripheral surface of said endless belt member, said endless belt member being twined around said delivery rotary member and being rotated with said delivery rotary member.

14. An image forming apparatus according to claim 11, further comprising:

paddle means for feeding the delivered sheet so as to pull the end of the delivered sheet into said stopper portion; and aligning means for aligning the delivered sheet pulled into said stopper portion in a direction orthogonal to a pull-in direction of the delivered sheet, wherein during operations of said paddle means and said aligning means, said endless belt member is pulled by said traction means to thereby retract said endless belt member to a position in which said endless belt member does not hamper the operations of said paddle means and said aligning means.

15. An image forming apparatus according to claim 11, further comprising height detecting means for detecting the height of the sheets stacked on said stacking tray means, and wherein said traction means is operated in conformity with the detected height.

16. An image forming apparatus according to claim 11, wherein a number of the sheets stacked on said stacking tray means is counted to thereby calculate the height of the sheets stacked on said stacking tray means, and said traction means is operated in conformity with a calculated height.

17. An image forming apparatus according to claim 11, wherein when said traction means is operated and said endless belt member is pulled thereby, said endless belt member is moved substantially upwardly from said stacking tray means.

18. An image forming apparatus according to claim 17, wherein said traction means includes a floating runner rotatable by a movement of an inner peripheral surface of said endless belt member contacting with said floating runner, and moving means for moving said floating runner in the predetermined direction.

19. An image forming apparatus according to claim 11, wherein said controller controls the amount of movement of said traction means once for each delivered sheet so as to maintain a sheet feeding force of said endless belt member substantially constant irrespective of the height of the stacked sheets.

20. An image forming apparatus according to claim 11, wherein said controller controls the amount of movement of said traction means once for a number of delivered sheet so as to maintain a sheet feeding force of said endless belt member substantially constant irrespective of the height of the stacked sheets.

21. A sheet treating apparatus according to claim 1, wherein said controller controls the amount of movement of said traction means so as to maintain a sheet feeding force of said endless belt member substantially constant irrespective of the height of the stacked sheets.

22. An image forming apparatus according to claim 11, wherein said controller controls the amount of movement of said traction means so as to maintain a sheet feeding force of said endless belt member substantially constant irrespective of the height of stacked sheets.

* * * * *

UNITED STATES PATENT AND TRADEMARK OFFICE

CERTIFICATE OF CORRECTION

PATENT NO. : 6,702,279 B2
DATED : March 9, 2004
INVENTOR(S) : Seiichiro Adachi et al.

It is certified that error appears in the above-identified patent and that said Letters Patent is hereby corrected as shown below:

Column 4,
Line 10, “arrive” should read -- arrive at --.

Column 15,
Line 29, “sheet,” should read -- sheet), --.

Column 16,
Line 57, “non-sort,” should read -- nonsort, --.

Column 19,
Line 39, “align” should read -- aligns --.

Column 24,
Line 7, “sheet” should read -- sheets --.

Signed and Sealed this

Eighth Day of June, 2004

JON W. DUDAS
*Acting Director of the United States Patent and Trademark Office*